US011338536B2

(12) United States Patent
Yokota et al.

(10) Patent No.: US 11,338,536 B2
(45) Date of Patent: May 24, 2022

(54) BOX OPENING DEVICE

(71) Applicant: ISHIDA CO., LTD., Kyoto (JP)

(72) Inventors: Yuji Yokota, Ritto (JP); Yoshinobu Shimomae, Ritto (JP); Atsushi Takahashi, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 176 days.

(21) Appl. No.: 16/318,714

(22) PCT Filed: Jun. 22, 2017

(86) PCT No.: PCT/JP2017/023103
§ 371 (c)(1),
(2) Date: Jan. 18, 2019

(87) PCT Pub. No.: WO2018/016264
PCT Pub. Date: Jan. 25, 2018

(65) Prior Publication Data

US 2019/0184671 A1 Jun. 20, 2019

(30) Foreign Application Priority Data

Jul. 22, 2016 (JP) ..... JP2016-144575

(51) Int. Cl.
*B31B 50/78* (2017.01)
*B31B 50/80* (2017.01)
(Continued)

(52) U.S. Cl.
CPC ..... *B31B 50/78* (2017.08); *B31B 50/802* (2017.08); *B65B 43/26* (2013.01); *B65B 43/265* (2013.01);
(Continued)

(58) Field of Classification Search
CPC ..... B31B 50/804; B65B 43/265
(Continued)

(56) References Cited

U.S. PATENT DOCUMENTS 6,669,616 B1 * 12/2003 Bierenacki ..... B31B 50/00 493/309
6,913,568 B2 * 7/2005 Frank ..... B31B 50/80 493/309
(Continued)

FOREIGN PATENT DOCUMENTS

CN 102574352 A 7/2012
CN 204161669 U 2/2015
(Continued)

OTHER PUBLICATIONS

The Office Action from the corresponding Chinese Patent Application No. 201780040799.9 dated Jan. 6, 2020.
(Continued)

*Primary Examiner* — Thanh K Truong
*Assistant Examiner* — Patrick B Fry
(74) *Attorney, Agent, or Firm* — Shinjyu Global IP

(57) ABSTRACT

A box-opening device is disclosed. The box-opening device includes a first holding part that holds a first surface and a second holding part that holds a second surface. The first surface is one of two adjacent surfaces of a folded corrugated cardboard sheet, and the second surface is the other of the two adjacent surfaces of the corrugated cardboard sheet. The box-opening device also includes a first holding part movement mechanism which changes a position of the first holding part with respect to the second holding part and thereby transforms the corrugated cardboard sheet into an opened state. The first holding part movement mechanism has a support member that supports the first holding part so that the part rotates on an arc track about a central axis of rotation that overlaps an imaginary line extending along a boundary line between the first surface and the second surface.

5 Claims, 12 Drawing Sheets

(51) Int. Cl.

| | |
|---|---|
| ***B65B 43/26*** | (2006.01) |
| *B31B 110/35* | (2017.01) |
| *B31B 100/00* | (2017.01) |
| *B31B 120/10* | (2017.01) |
| *B31B 120/30* | (2017.01) |
| *B31B 120/70* | (2017.01) |

(52) U.S. Cl.
CPC ... *B31B 2100/0022* (2017.08); *B31B 2110/35* (2017.08); *B31B 2120/102* (2017.08); *B31B 2120/302* (2017.08); *B31B 2120/70* (2017.08)

(58) Field of Classification Search
USPC ..... 493/309, 315
See application file for complete search history.

(56) References Cited

U.S. PATENT DOCUMENTS

| | | | | |
|---|---|---|---|---|
| 7,390,291 | B2 * | 6/2008 | Chiu Chen | 493/313 |
| 7,585,265 | B2 * | 9/2009 | Gebhardt | 493/70 |
| 7,788,881 | B2 * | 9/2010 | Johnson | B65B 43/265 53/382.1 |
| 8,146,972 | B2 * | 4/2012 | Petijean | B65B 43/305 294/186 |
| 8,181,427 | B2 * | 5/2012 | Kobierzycki | B65B 43/305 53/376.7 |
| 8,282,537 | B2 * | 10/2012 | Gebhardt | 493/70 |
| 9,126,380 | B2 * | 9/2015 | Dittmer | B31B 50/00 |
| 2004/0110619 | A1 | 6/2004 | Frank et al. | |
| 2007/0293383 | A1 | 12/2007 | Gebhardt et al. | |
| 2012/0122646 | A1 | 5/2012 | Murano | |
| 2013/0040795 | A1 | 2/2013 | Murano | |

FOREIGN PATENT DOCUMENTS

| | | | |
|---|---|---|---|
| DE | 2323644 | A1 | 11/1974 |
| JP | 2000-006909 | A | 1/2000 |
| JP | 2009-012859 | A | 1/2009 |
| WO | 2015/107798 | A1 | 7/2015 |

OTHER PUBLICATIONS

The Search Report from the corresponding International Patent Application No. PCT/JP2017/023103 dated Aug. 1, 2017.
The Preliminary Report on Patentability (with Written Opinion) from the corresponding International Patent Application No. PCT/JP2017/023103 dated Jan. 31, 2019.
The Search Report from the corresponding European Patent Application No. 17830784.9 dated May 22, 2019.

* cited by examiner

BOX OPENING DEVICE

CROSS-REFERENCE TO RELATED APPLICATIONS

This application is the national stage in the United States of International Application No. PCT/JP2017/023103, filed Jun. 22, 2017, which claims priority to Japanese Patent Application No. 2016-144575, filed Jul. 22, 2016. Both of those applications are incorporated by reference herein in their entireties.

TECHNICAL FIELD

The present invention pertains to a box-opening device. More specifically, the present invention pertains to a box-opening device that transforms a folded corrugated cardboard sheet to an opened state.

BACKGROUND ART

Conventionally, as disclosed in patent document 1 (Japanese Laid-open Patent Application No. 2000-6909), box-opening devices that transform a folded corrugated cardboard sheet into an opened state by holding two adjacent surfaces of the folded corrugated cardboard sheet respectively with holding parts, and changing a position of one of the holding parts that is holding one of the surfaces with respect to the other holding part that is holding the other surface. This type of box-opening device can efficiently open corrugated cardboard sheets into boxes without relying on manpower.

SUMMARY OF THE INVENTION

For cases in which two adjacent surfaces of a corrugated cardboard sheet are held to open into a box, the corrugated cardboard sheet is opened into a box by rotating one of the held surfaces with respect to the other held surface about a boundary line (fold portion) between the two held surfaces. In other words, a box-opening device such as that disclosed by patent document 1 (Japanese Laid-open Patent Application No. 2000-6909), changes the position of the holding part holding the one surface with respect to the holding part holding the other surface so that the one of the held surface rotates with respect to the other held surface about the abovementioned boundary line. However, depending on the way for changing the position of the holding part, there are cases that the one held surface cannot smoothly rotates with respect to the other held surface about the abovementioned boundary line. In such cases, depending on the characteristics and state of the corrugated cardboard sheet, problems, such that the corrugated cardboard sheet (corrugated cardboard box) is damaged or deformed while the sheet is opening into a box, or opening into a box is failed due to release of the holding of the corrugated cardboard sheet at an unintended timing, may occur.

An object of the present disclosure is to provide a highly reliable box-opening device which can reliably open a corrugated cardboard sheet into an opened state by holding two adjacent surfaces of the corrugated cardboard sheet respectively with holding parts and changing the position of a holding part that is holding the one surface with respect to another holding part holding the other surface without damaging or deforming the corrugated cardboard sheet.

A box-opening device according to the first aspect of the present disclosure is provided with a first holding part, a second holding part, and a first holding part movement mechanism. The first holding part holds a first surface, which is one of two adjacent surfaces of a folded corrugated cardboard sheet. The second holding part holds a second surface, which is the other surface of the two adjacent surfaces of the corrugated cardboard sheet. The first holding part movement mechanism changes a position of the first holding part with respect to the second holding part and thereby transforms the corrugated cardboard sheet into an opened state. The first holding part movement mechanism has a support member that supports the first holding part so that the first holding part rotates on an arc track about a central axis of rotation that overlaps an imaginary line extending along a boundary line between the first surface and the second surface.

In the box-opening device disclosed by patent document 1 (Japanese Laid-open Patent Application No. 2000-6909), as illustrated in FIG. 5 of patent document 1 (Japanese Laid-open Patent Application No. 2000-6909), the central axis of rotation of a suction pad that holds one of two adjacent surfaces of a corrugated cardboard sheet and is rotated in order to transform the corrugated cardboard sheet into an opened state, is not aligned with the boundary line (fold portion) between the two adjacent surfaces of the corrugated cardboard sheet. With such a configuration, the surface held by the rotating suction pad cannot smoothly turn about the abovementioned boundary line with respect to the surface held by the other suction pad. In other words, in the box-opening device disclosed by patent document 1 (Japanese Laid-open Patent Application No. 2000-6909), on the surface of the corrugated cardboard sheet held by the rotating suction pad, a force is also applied in a direction that is different from the direction (circumferential direction about the abovementioned boundary line as the central axis) in which the force should be applied to open the sheet into the box. Therefore, with the box-opening device of patent document 1 (Japanese Laid-open Patent Application No. 2000-6909), according to the characteristics and state of the corrugated cardboard sheet, problems, such that the corrugated cardboard sheet (corrugated cardboard box) is damaged or deformed during the sheet is opened into a box, or opening the sheet into a box is failed due to release of the holding of the corrugated cardboard sheet at an unintended timing, may occur.

In contrast, with the box-opening device according to the first aspect of the present disclosure, a force can be applied on the first surface of a corrugated cardboard sheet held by the first holding part, solely in the direction in which a force should be applied to open the sheet into a box. Therefore, the corrugated cardboard sheet can be reliably opened into a box without damaging or deforming the corrugated cardboard sheet.

A box-opening device according to the second aspect of the present disclosure is the box-opening device according to the first aspect, wherein the central axis of rotation is immobile during rotation of the first holding part.

With the box-opening device according to the second aspect of the present disclosure, it is easy to apply a force on the first surface of the corrugated cardboard sheet solely in the direction in which the force should be applied to open the sheet into a box, and it is therefore easy to reliably open the corrugated cardboard sheet into a box without damaging or deforming the corrugated cardboard sheet.

A box-opening device according to the third aspect of the present disclosure is the box-opening device according to the first aspect or the second aspect, wherein a distance between the central axis of rotation and the first holding part is constant during rotation of the first holding part.

With the box-opening device according to the third aspect of the present disclosure, it is easy to apply a force on the first surface of the corrugated cardboard sheet solely in the direction in which the force should be applied to open the sheet into a box, and it is therefore easy to reliably open the corrugated cardboard sheet into a box without damaging or deforming the corrugated cardboard sheet.

A box-opening device according to the fourth aspect of the present disclosure is the box-opening device according to any of the first aspect to the third aspect, wherein the support member includes an arm member and a bearing. The first holding part is attached to the arm member. The bearing defines a central turning axis disposed on the imaginary line, and rotatably supports the arm member.

With the box-opening device according to the fourth aspect of the present disclosure, the arm member to which the first holding part is attached is rotatably supported by the bearing, which has a central turning axis disposed on an imaginary line of the boundary line between the first surface and the second surface. Therefore, it is easy to apply a force on the first surface of the corrugated cardboard sheet solely in the direction in which the force should be applied to open the sheet into a box, and it is therefore easy to reliably open the corrugated cardboard sheet into a box without damaging or deforming the corrugated cardboard sheet.

A box-opening device according to the fifth aspect of the present disclosure is the box-opening device according to any of the first aspect to the third aspect, wherein the support member is a link mechanism. In an extension direction of the boundary line of the corrugated cardboard sheet that is opened by the first holding part movement mechanism, the link mechanism is disposed within a positional range at which the boundary line is present.

With the box-opening device according to the fifth aspect of the present disclosure, in the extension direction of the boundary line of the corrugated cardboard sheet that is opened into a box, the link mechanism is disposed within the positional range at which the boundary line is present. Therefore, the box-opening device can be made more compact in the direction along which the boundary line of the opened corrugated cardboard sheet extends.

A box-opening device according to the sixth aspect of the present disclosure is the box-opening device according to any of the first aspect to the fifth aspect and is further provided with a second holding part movement mechanism that rotates the second holding part about a prescribed rotation axis.

With the box-opening device according to the sixth aspect of the present disclosure, the second holding part can also be rotated, and the second holding part can be moved with respect to the corrugated cardboard sheet. Therefore, the corrugated cardboard sheet supplied to the box-opening device can be firmly held by the first holding part and the second holding part.

ADVANTAGEOUS EFFECTS OF INVENTION

With the box-opening device according to the present disclosure, a force can be applied on the first surface of the corrugated cardboard sheet held by the first holding part, solely in the direction in which a force should be applied to open the sheet into a box. Therefore, the corrugated cardboard sheet can be reliably opened into a box without damaging or deforming the corrugated cardboard sheet.

DESCRIPTION OF EMBODIMENTS

Figure 1:
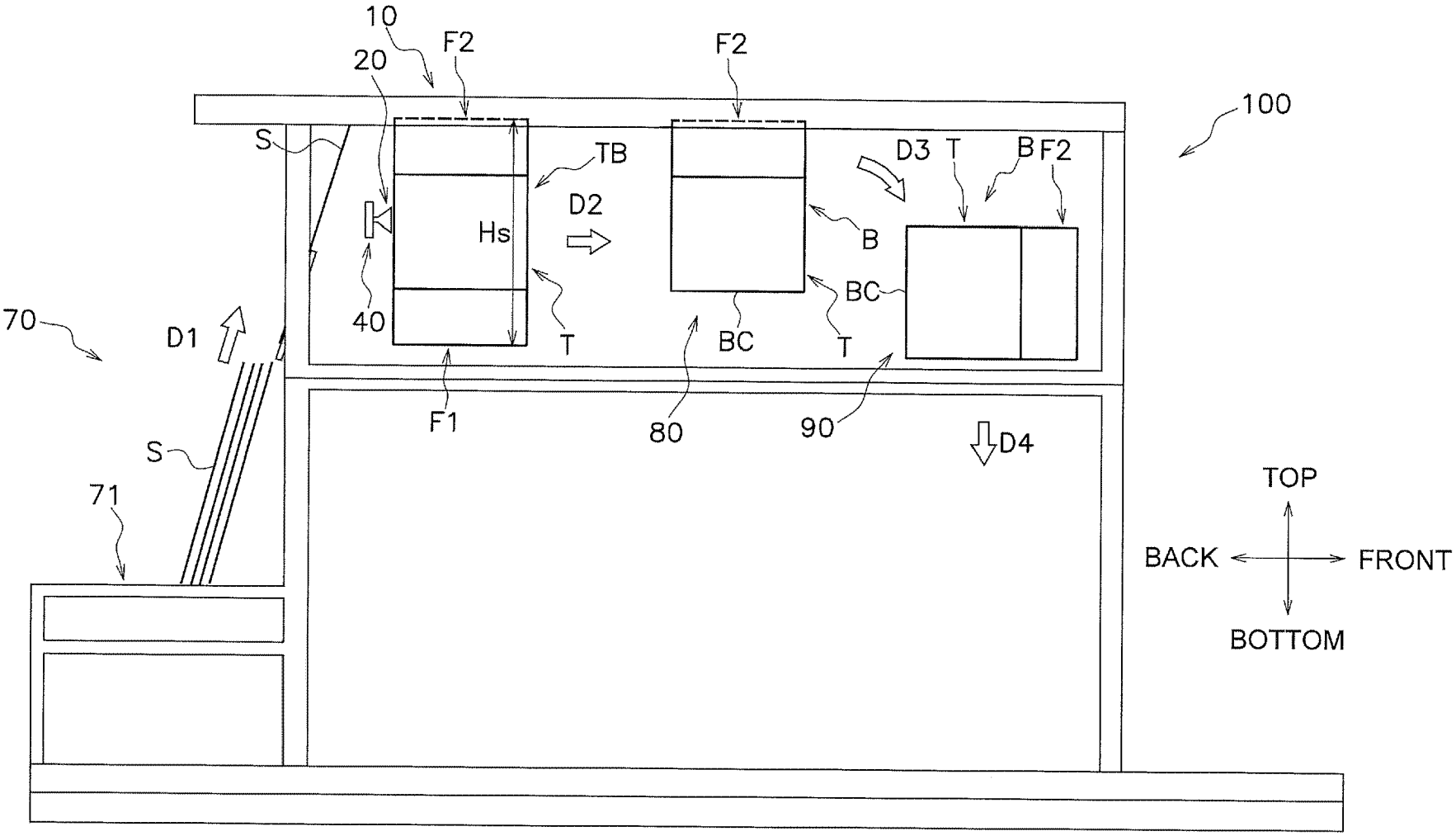
FIG. 1 is a schematic side view of a box manufacturing system having a box-opening device according to a first embodiment of the present disclosure.

Embodiments for carrying out the box-opening device according to the present invention are described with reference to the drawings. The embodiments described below are examples of the present invention, do not limit the technical scope of the present invention, and can be modified as appropriate.

In the description below, expressions such as top, bottom, front (front surface), back (rear surface), left and right may be used in order to describe positional relationships and orientation. Unless otherwise noted, the directions indicated by these expressions are in accordance with the directions of arrows illustrated in the drawings.

Furthermore, in the following description, expressions such as parallel, orthogonal, horizontal, vertical, and identical may be used, but these expressions do not refer to only relationships being parallel, orthogonal, horizontal, vertical, identical or the like in a strict sense. These expressions such as parallel, orthogonal, horizontal, vertical, and identical also include relationships being substantially parallel, orthogonal, horizontal, vertical, identical or the like.

First Embodiment

(1) Overall Configuration

A box manufacturing system 100 that includes a box-opening device 200 according to a first embodiment of the present invention is described below.

Figure 4:
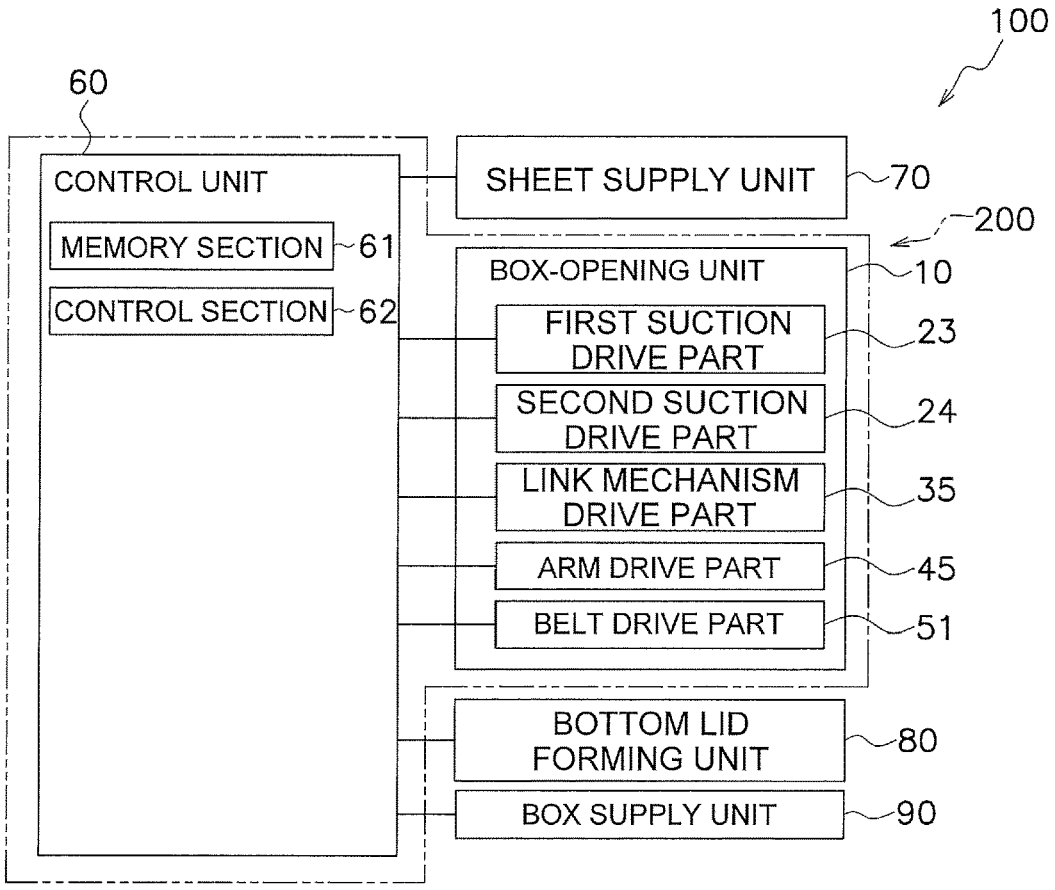
FIG. 4 is a block diagram of the box manufacturing system of FIG. 1.

FIG. 1 is a schematic side view (right side view) of the box manufacturing system 100 that includes the box-opening device 200 according to the first embodiment of the present invention. FIG. 4 is a block diagram of the box manufacturing system 100 that includes the box-opening device 200.

The box manufacturing system 100 primarily includes a sheet supply unit 70, a box-opening unit 10, a bottom lid forming unit 80, a box supply unit 90, and a control unit 60 (see FIG. 1 and FIG. 4). The control unit 60 is a common control unit for the sheet supply unit 70, the box-opening unit 10, the bottom lid forming unit 80, and the box supply unit 90. The control unit 60 controls the operation of each unit of the box manufacturing system 100.

The box-opening device 200 primarily has the box-opening unit 10 and the control unit 60 (see FIG. 4). In the present embodiment, the box-opening device 200 forms the box manufacturing system 100 together with the other units 70, 80, and 90, but not limited to. The box-opening device 200 may be a device which is independent from the other units 70, 80, and 90. For example, the control unit 60 may be a control unit that is dedicated to the box-opening unit 10. Furthermore, for example, the box-opening unit 10 may be supported by a frame that is different from a frame that supports the other units 70, 80, and 90.

Figure 2:
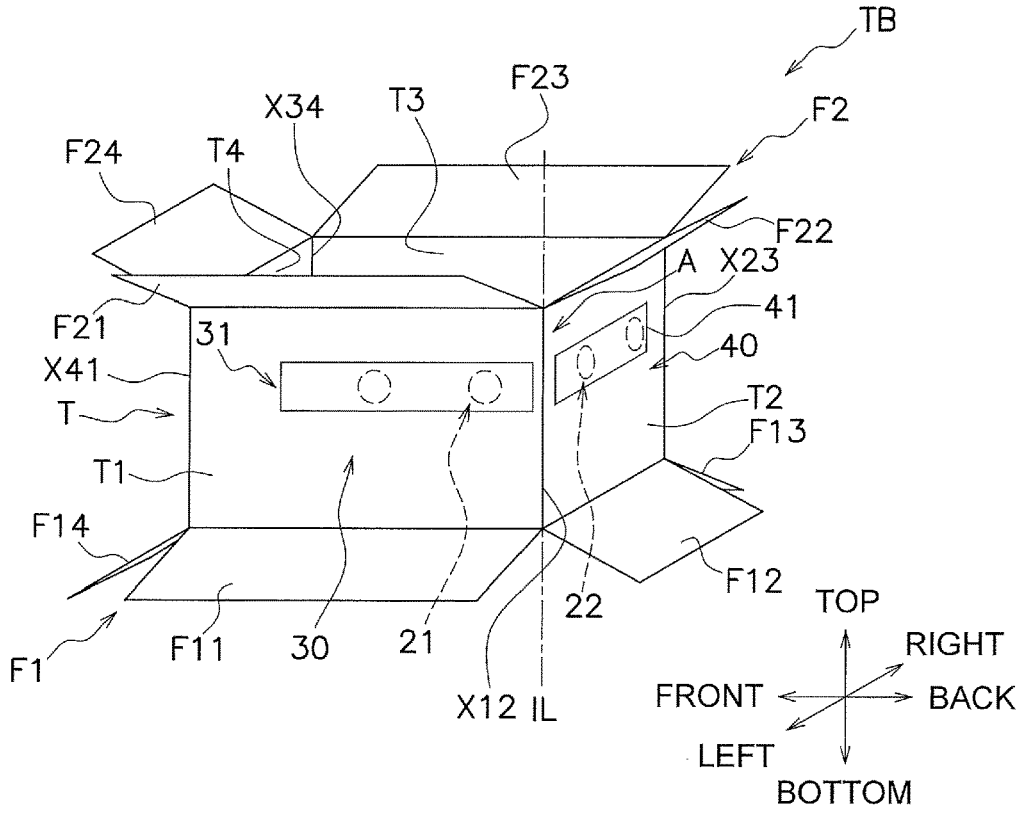
FIG. 2 is a schematic perspective view of an opened corrugated cardboard sheet (tubular corrugated cardboard box before the bottom lid being formed) opened by the box-opening device of FIG. 1.
Figure 3A:
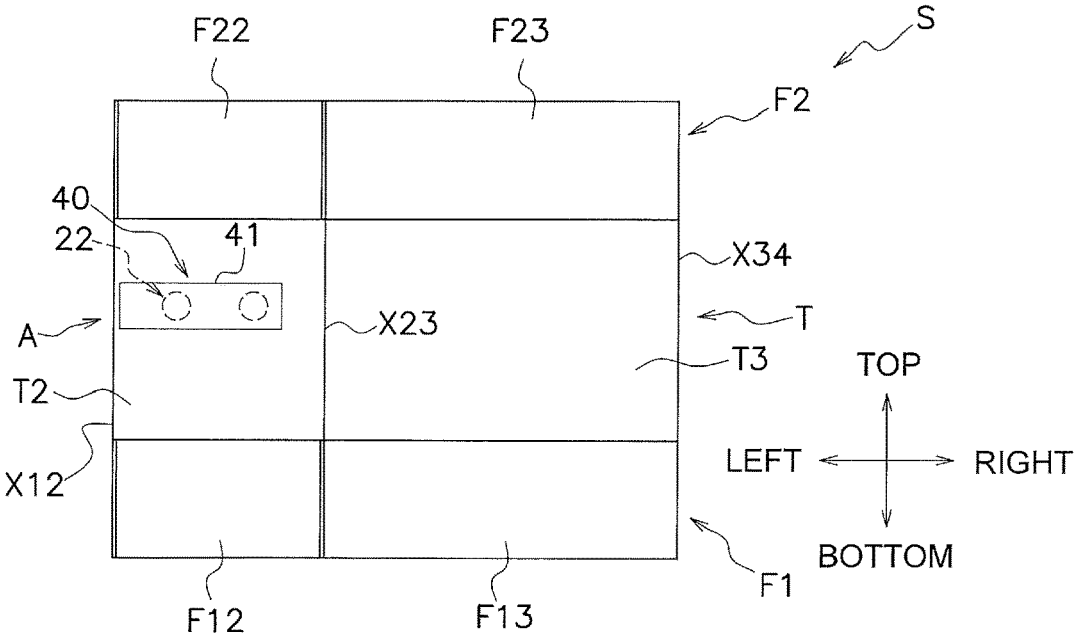
FIG. 3A is a schematic rear view that schematically depicts a state that a box-opening unit of the box-opening device in the box manufacturing system of FIG. 1 has received a folded corrugated cardboard sheet supplied from a sheet supply unit.
Figure 3B:
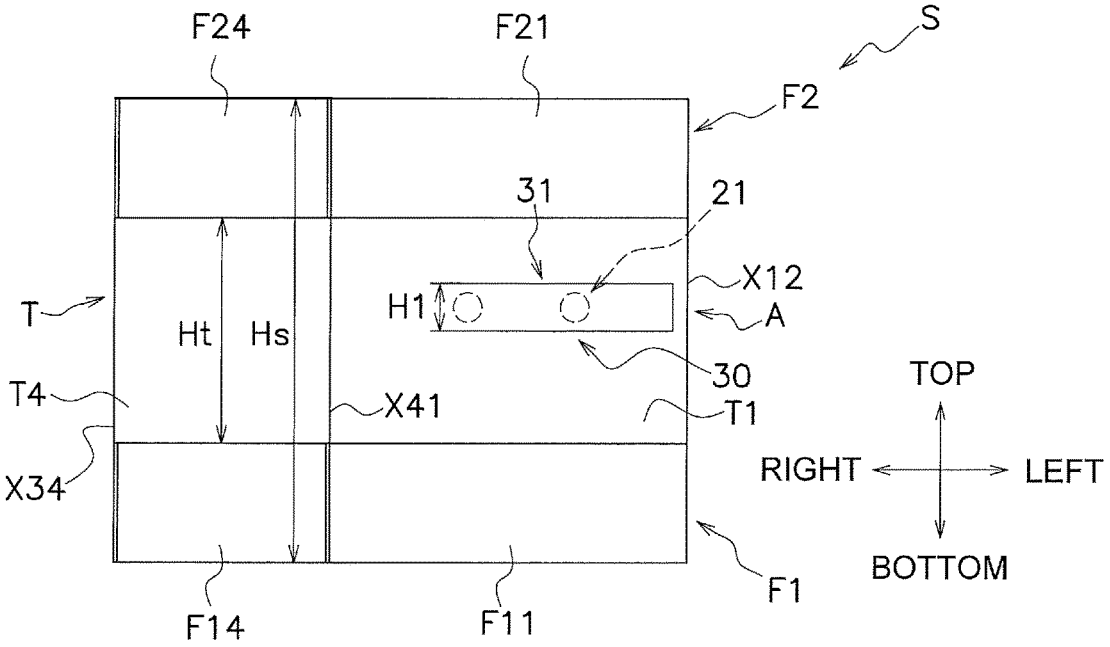
FIG. 3B is a schematic front view that schematically depicts the state that the box-opening unit of the box-opening device in the box manufacturing system of FIG. 1 has received the folded corrugated cardboard sheet supplied from the sheet supply unit.

The box manufacturing system 100 transforms a folded corrugated sheet S into an opened state as illustrated in FIGS. 3A and 3B, and forms a tubular corrugated cardboard box (hereinafter, referred to as a tubular corrugated cardboard box TB) (see FIG. 2). The box manufacturing system 100 further forms a bottom lid BC on the tubular corrugated cardboard box TB, and thereby forms a corrugated cardboard box B with the top lid side opened. The box manufacturing system 100 then supplies the formed corrugated cardboard box B to a box packing device (not illustrated) that fills articles into the corrugated cardboard box B.

(2) Detailed Configuration

(2-1) Tubular Corrugated Cardboard Box and Corrugated Cardboard Sheet

First, the tubular corrugated cardboard box TB and the corrugated cardboard sheet S are described with reference to FIGS. 2, 3A and 3B.

FIG. 2 is a perspective view of the tubular corrugated cardboard box TB. More specifically, FIG. 2 is a schematic perspective view that schematically depicts the tubular corrugated cardboard box TB, as viewed from the back left side of the box manufacturing system 100, which is opened and formed by the box-opening unit 10.

FIG. 3A illustrates the folded corrugated cardboard sheet S as viewed from one side, and FIG. 3B illustrates the folded corrugated cardboard sheet S as viewed from the other side. More specifically, FIG. 3A is a schematic rear view that schematically depicts a state that the box-opening unit 10 has received the folded corrugated cardboard sheet S supplied from the sheet supply unit 70. FIG. 3B is a schematic front view that schematically depicts a state that the box-opening unit 10 has received the folded corrugated cardboard sheet S supplied from the sheet supply unit 70.

(2-1-1) Tubular Corrugated Cardboard Box

As illustrated in FIG. 2, the tubular corrugated cardboard box TB has primarily a side surface section T, top lid side flaps F2, and bottom lid side flaps F1.

The side surface section T forms the side surfaces of the corrugated cardboard box B. In the tubular corrugated cardboard box TB, the side surface section T has a square tube shape. As illustrated in FIG. 2, the side surface section T includes a first side surface T1, a second side surface T2, a third side surface T3, and a fourth side surface T4. The first side surface T1, second side surface T2, third side surface T3, and fourth side surface T4 are annularly connected in this order (see FIG. 2). In addition, the side surface section T has a first fold portion X12, a second fold portion X23, a third fold portion X34, and a fourth fold portion X41 (see FIG. 2). The first fold portion X12 is arranged at the boundary between the first side surface T1 and the second side surface T2. The second fold portion X23 is arranged at the boundary between the second side surface T2 and the third side surface T3. The third fold portion X34 is arranged at the boundary between the third side surface T3 and the fourth side surface T4. The fourth fold portion X41 is arranged at the boundary between the fourth side surface T4 and the first side surface T1. In the tubular corrugated cardboard box TB, two adjacent side surfaces that sandwich each fold portion X12, X23, X34, and X41 are orthogonal to each other. In addition, the first side surface T1 and the third side surface T3 of the side surface section T are parallel, and the second side surface T2 and the fourth side surface T4 are parallel.

The top lid side flaps F2 are disposed at one opened side of the tubular side surface section T. The top lid side flaps F2 are flaps that are folded to form the top lid of the corrugated cardboard box B. The top lid formed by the top lid side flaps F2 closes an opening at one side of the side surface section T. As illustrated in FIG. 2, the top lid side flaps F2 include a flap F21, a flap F22, a flap F23, and a flap F24. The flap F21 is connected to and extends from the first side surface T1. The flap F22 is connected to and extends from the second side surface T2. The flap F23 is connected to and extends from the third side surface T3. The flap F24 is connected to and extends from the fourth side surface T4.

The bottom lid side flaps F1 are disposed at one opening side of the side surface section T (a side that differs from the side at which the top lid side flaps F2 are disposed). The bottom lid side flaps F1 are flaps that are folded to form a bottom lid BC of the corrugated cardboard box B. The bottom lid BC formed from the bottom lid side flaps F1 closes an opening at one side of the side surface section T (an opening of the side that is opposite the opening closed by the top lid). As illustrated in FIG. 2, the bottom lid side flaps F1 include a flap F11, a flap F12, a flap F13, and a flap F14. The flap F 11 is connected to and extends from one end part of the first side surface T1 which is arranged opposite to the other end part of the first side surface T1 to which the flap F21 is connected. The flap F12 is connected to and extends from one end part of the second side surface T2 which is arranged opposite to the other end part of the second side surface T2 to which the flap F22 is connected. The flap F13 is connected to and extends from one end part of the third side surface T3 which is arranged opposite to the other end part of the third side surface T3 to which the flap F23 is connected. The flap F14 is connected to and extends from one end part the fourth side surface T4 which is arranged opposite to the other end part of the fourth side surface T4 to which the flap F24 is connected.

(2-1-2) Corrugated Cardboard Sheet

The corrugated cardboard sheet S is the form of the tubular corrugated cardboard box TB when folded into a planar shape (see FIGS. 3A and 3B).

In the corrugated cardboard sheet S, the side surface section T, which has a square tubular shape when in the form of the tubular corrugated cardboard box TB, is folded into a planar shape.

More specifically, the corrugated cardboard sheet S is in a state in which the side surface section T is largely bent along two opposing fold portions (the first fold portion X12 and the third fold portion X34). The corrugated cardboard sheet S is bent so that the angles formed by two adjacent surfaces that sandwich the first fold portion X12 and the third fold portion X34 respectively become substantially 0°. In other words, the corrugated cardboard sheet S is bent along the first fold portion X12 so that an inner wall of the first side surface T1 and an inner wall of the second side surface T2 are disposed adjacent to each other. Also, the corrugated cardboard sheet S is bent along the third fold portion X34 so that an inner wall of the third side surface T3 and an inner wall of the fourth side surface T4 are disposed adjacent to each other.

Furthermore, the corrugated cardboard sheet S is folded so that angles formed by two adjacent surfaces that sandwich the second fold portion X23 and the fourth fold portion X41 respectively become substantially 180°. In the corrugated cardboard sheet S, the second fold portion X23 is in an opened state so that the inner wall of the second side surface T2 and the inner wall of the third side surface T3 are separated from each other. In addition, in the corrugated cardboard sheet S, the fourth fold portion X41 is in an opened state so that the inner wall of the fourth side surface T4 and the inner wall of the first side surface T1 are separated from each other.

In the folded corrugated cardboard sheet S, the first side surface T1, and the flap F21 and the flap F11 connected to the first side surface T1 are disposed on the same virtual plane. In addition, the second side surface T2, and the flap F22 and the flap F12 connected to the second side surface T2 are disposed on the same virtual plane. Furthermore, the third side surface T3, and the flap F23 and the flap F13 connected to the third side surface T3 are disposed on the same virtual plane. Moreover, the fourth side surface T4, and the flap F24 and the flap F14 connected to the fourth surface T4 are disposed on the same virtual plane.

(2-2) Box Manufacturing System

The box manufacturing system 100 is described.

The box manufacturing system 100 forms a corrugated cardboard box B with a closed bottom lid BC while moving the corrugated cardboard sheet S and the tubular corrugated cardboard box TB, and supplies the formed corrugated cardboard box B to a box packing device (not illustrated).

The sheet supply unit 70 of the box manufacturing system 100 takes out one of corrugated cardboard sheet S stacked in a stack section 71 each time (see FIG. 1), move the corrugated cardboard sheet S to the box-opening unit 10 positioned obliquely above and in front of the stack section 71 using a sheet movement mechanism (not illustrated) (see arrow D1 in FIG. 1).

In the stack section 71, multiple corrugated cardboard sheets S are stacked in a state that the bottom lid side flaps F1 side is oriented downward and the top lid side flaps F2 side is oriented upward. The corrugated cardboard sheets S are stacked in the stack section 71 such that the second side surface T2 and the third side surface T3 are arranged at the back side and the first side surface T1 and the fourth side surface T4 are arranged at the front side. Also, the corrugated cardboard sheets S are stacked in the stack section 71 such that the first side surface T1 and the second side surface T2 are arranged at the left side and the third side surface T3 and the fourth side surface T4 are arranged at the right side. While maintaining this posture (while maintaining a state in which the bottom lid side flaps F1 side is oriented downward, the top lid side flaps F2 side is oriented upward, the second side surface T2 and the third side surface T3 are arranged at the back side, the first side surface T1 and the fourth side surface T4 are arranged at the front side, the first side surface T1 and the second side surface T2 are arranged at the left side, and the third side surface T3 and the fourth side surface T4 are arranged at the right side), the sheet supply unit 70 supplies corrugated cardboard sheets S stacked in the stack section 71 to the box-opening unit 10. Each time, the sheet supply unit 70 supplies a corrugated cardboard sheet S to the box-opening unit 10 to the same position so as not to cause the position aberration in the left-right direction.

The box-opening unit 10 unfolds the corrugated cardboard sheet S supplied by the sheet supply unit 70, and transforms the corrugated cardboard sheet S into a tubular corrugated cardboard box TB. In other words, the box-opening unit 10 transforms that folded corrugated cardboard sheet S supplied by the sheet supply unit 70 to an opened state, and forms the tubular corrugated cardboard box TB. The box-opening unit 10 moves the opened corrugated cardboard sheet S (tubular corrugated cardboard box TB) forward (see arrow D2 in FIG. 1), and delivers the opened corrugated cardboard sheet S to the bottom lid forming unit 80. The box-opening unit 10 will be described in detail later.

The bottom lid forming unit 80 close the bottom lid side flaps F1 and form the bottom lid BC for the tubular corrugated cardboard box TB with a flap closure mechanism (not illustrated), and thereby forms the corrugated cardboard box B in which the opening at the bottom lid BC side is closed. More specifically, the bottom lid forming unit 80 fold, with a flap closure mechanism (not illustrated), the bottom lid side flaps F1 of the tubular corrugated cardboard box TB so that the flap F12 and the flap F14 are arranged at the inside and the flap F11 and the flap F13 are arranged at the outside while moving the tubular corrugated cardboard box TB with a movement mechanism (not illustrated) (see arrow D2 in FIG. 1). That is, the flap closure mechanism of the bottom lid forming unit 80 first folds the flap F12 and the flap F14 of the bottom lid side flaps F1 so as to cover the bottom lid side opening of the side surface section T, and then folds the flap F11 and the flap F13 so as to cover the folded flap F12 and flap F14 from the outside. Furthermore, the bottom lid forming unit 80, while moving the tubular corrugated cardboard box TB forward (see arrow D2 in FIG. 1) with the movement mechanism (not illustrated), affixes a tape (not illustrated) to the fourth side surface T4, the flaps F11 and F13, and the second side surface T2 in this order with a tape affixing mechanism (not illustrated) so as to cover a gap between the folded flap F11 and flap F13, and thereby forms the bottom lid BC of the corrugated cardboard box B. The bottom lid forming unit 80 moves the corrugated cardboard box B with the formed bottom lid BC further forward (see arrow D2 in FIG. 1) with the movement mechanism (not illustrated), and delivers the corrugated cardboard box B to the box supply unit 90.

The method for forming the bottom lid by the flap closure mechanism of the bottom lid forming unit 80 is merely an example, and it is not limited thereto. For example, the flap closure mechanism may form the bottom lid BC by folding the bottom lid side flaps F1 in an interleaved manner without using tapes. For example, more specifically, the flap closure mechanism may form the bottom lid BC by folding in the bottom lid side flaps F1 so that a portion of the flap F12 overlaps the outside of the flap F11, a portion of the flap F13 overlaps the outside of the flap F12, a portion of the flap F14 overlaps the outside of the flap F13, and a portion of the flap F11 overlaps the outside of the flap F14.

The box supply unit 90 turns, with a turning mechanism (not illustrated), the corrugated cardboard box B whose opening faces upward and which is delivered from the bottom lid forming unit 80 in the clockwise direction (see arrow D3 in FIG. 1) when viewed from the right side, so that the opening faces forward. Furthermore, the box supply unit 90 drops, with a dropping mechanism (not illustrated), the corrugated cardboard box B whose opening faces forward (see arrow D4 in FIG. 1), and thereby supplies the box to the box packing device (not illustrated) located below.

The configuration of the box supply unit 90 is an example, and it is not limited thereto. For example, instead of dropping the corrugated cardboard box B whose opening faces forward, the box supply unit 90 may move the box upward or downward with an elevator mechanism (not illustrated) to supply the corrugated cardboard box B to the box packing device (not illustrated). Also, for example, in case that the box packing device is a type of device in which articles are packed into the corrugated cardboard box B whose opening faces upward, the box supply unit 90 may supply the corrugated cardboard box B to the box packing device without turning the corrugated cardboard box B (so that the opening remains facing upward).

The control unit 60 controls each unit of the box manufacturing system 100 including the sheet supply unit 70, the box-opening unit 10, the bottom lid forming unit 80, and the box supply unit 90. The control unit 60 will be described in detail later.

(2-2-1) Box-Opening Unit

The box-opening unit 10 converts the corrugated cardboard sheet S received from the sheet supply unit 70 to an opened state. In other words, the box-opening unit 10 opens the folded corrugated cardboard sheet S, and forms the tubular corrugated cardboard box TB.

As illustrated in FIG. 1, the box-opening unit 10 is arranged above and in front of the stack section 71 of the sheet supply unit 70. As illustrated by the arrow D1 of FIG. 1, the box-opening unit 10 receives the corrugated cardboard sheet S that is moved from an obliquely downward position, and opens the corrugated cardboard sheet S.

Figure 7:
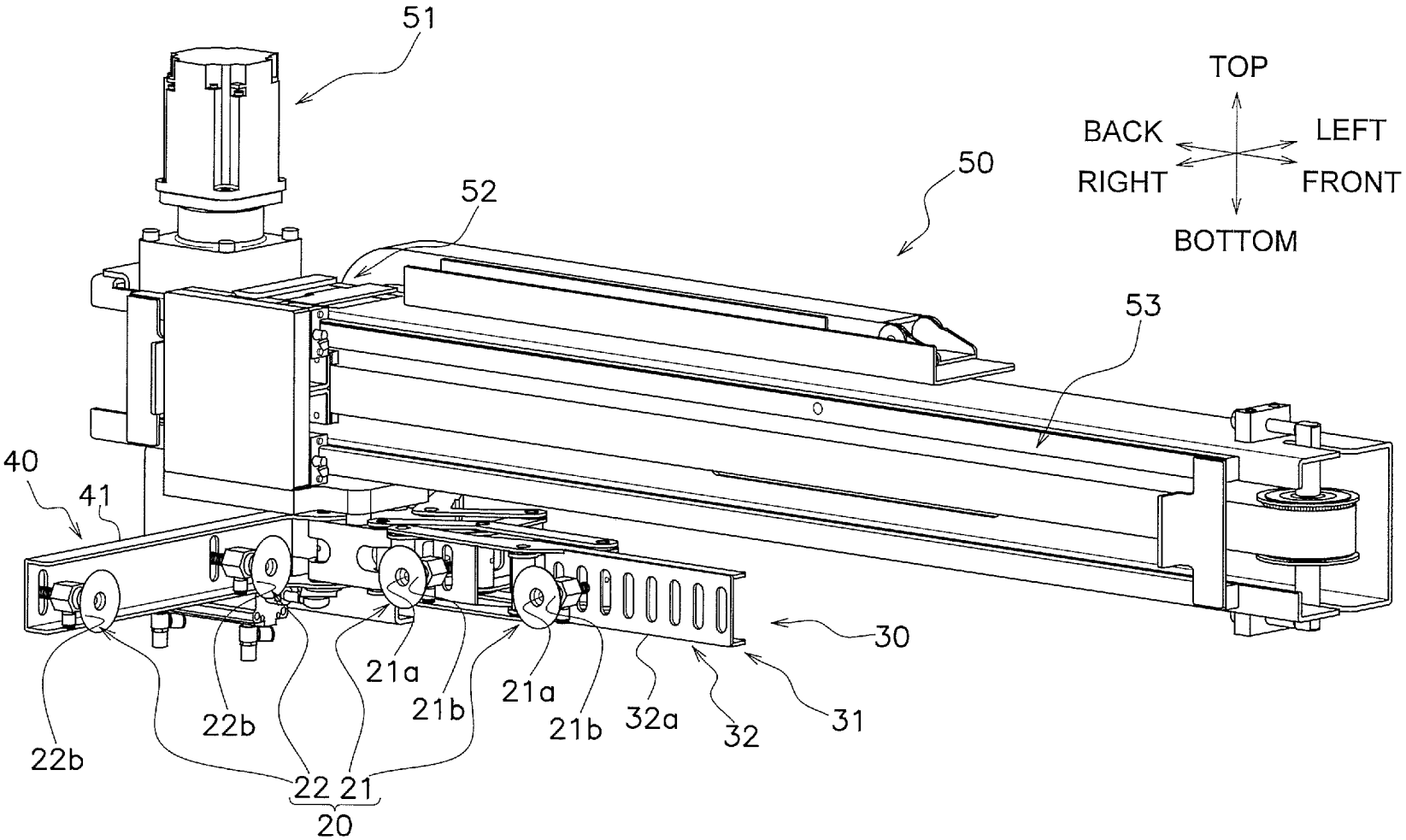
FIG. 7 is a perspective view of the box-opening unit, depicting the box-opening unit of the box-opening device of FIG. 1 as viewed obliquely from above at a forward right position and this figure depicts a state of the link mechanism of the first holding part movement mechanism and the arm member of the second holding part movement mechanism when opening of the corrugated cardboard sheet into a box has been completed (the depiction of corrugated cardboard sheet is omitted).

As illustrated in FIG. 7, the box-opening unit 10 is provided with primarily a holding mechanism 20, a first holding part movement mechanism 30, a second holding part movement mechanism 40, and a movement mechanism 50.

(2-2-1-1) Holding Mechanism

The holding mechanism 20 receives the corrugated cardboard sheet S supplied from the sheet supply unit 70, and holds the corrugated cardboard sheet S opened by the box-opening unit 10 (namely, the tubular corrugated cardboard box TB) until the opened corrugated cardboard sheet S is delivered to the bottom lid forming unit 80 for the next process.

The holding mechanism 20 includes two first suction cups 21, two second suction cups 22, a first suction drive unit 23, and a second suction drive unit 24 (see FIGS. 4 and 7). The first suction cup 21 is an example of the first holding part. The second suction cup 22 is an example of the second holding part. The first suction cup 21 and the second suction cup 22 are made of rubber, however they are not limited thereto.

The numbers of first suction cups 21 and second suction cups 22 presented here are merely specific examples, and the numbers are not limited thereto. The number of the first suction cups 21 and the number of the second suction cups 22 may be respectively one, three or more. In addition, the number of first suction cups 21 and the number of second suction cups 22 do not have to be the same.

The first suction drive unit 23 is a vacuum generator for suctioning air from the space between a suction attachment surface 21*b* (see FIG. 7) of the suction cup of each first suction cup 21 and the corrugated cardboard sheet S so that the first suction cups 21 stick to the side surface section T of the corrugated cardboard sheet S. The first suction drive unit 23 is a vacuum pump, however it is not limited thereto.

The second suction drive unit 24 is a vacuum generator for suctioning air from the space between a suction attachment surface 22*b* (see FIG. 7) of the suction cup of each second suction cup 22 and the corrugated cardboard sheet S so that the second suction cups 22 stick to the side surface section T of the corrugated cardboard sheet S. The second suction drive unit 24 a vacuum pump, however it is not limited thereto.

Figure 5A:
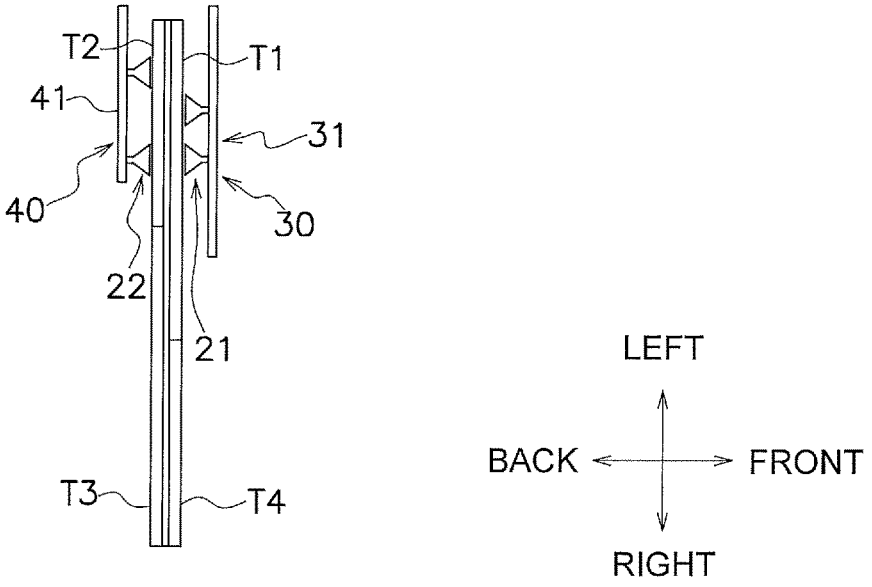
FIG. 5A is a schematic plan view that schematically depicts the state that the box-opening unit of the box-opening device in the box manufacturing system of FIG. 1 has received the folded corrugated cardboard sheet supplied from the sheet supply unit and this figure omits the depiction of the flaps of the corrugated cardboard sheet.

The first suction cups 21 hold the first side surface T1 (side surface arranged at the front left side) of the folded corrugated cardboard sheet S supplied by the sheet supply unit 70 (see FIG. 5A). Each first suction cup 21 keeps holding the first side surface T1 of the corrugated cardboard sheet S without releasing it until the corrugated cardboard sheet S has been opened into a box by the box-opening unit 10 and is then delivered to the bottom lid forming unit 80.

The first suction cups 21 are attached to a link mechanism 31 of the below-described first holding part movement mechanism 30 (see FIG. 7). When the first suction cups 21 receives the corrugated cardboard sheet S supplied by the sheet supply unit 70, the first suction cups 21 are moved by the link mechanism 31 from a position (standby position) such as that depicted in FIG. 8 in a bottom surface view, to a position (sheet receiving position) such as that depicted in FIG. 9, so as to contact the first surface side T1 of the corrugated cardboard sheet S from the front (see FIG. 5A). When the first suction cups 21 contact the first side surface T1 of the corrugated cardboard sheet S from the front, the first suction cups 21 push the first side surface T1 of the corrugated cardboard sheet S rearward to make the corrugated cardboard sheet S, that is transferred by the sheet supply unit 70 in a state that the top part thereof inclined forward (see FIG. 1), into a vertical state. In other words, when the first suction cups 21 contact the first side surface T1 of the corrugated cardboard sheet S from the front, the first suction cups 21 push the first side surface T1 of the corrugated cardboard sheet S rearward and change the orientation of the corrugated cardboard sheet S from a state that the top part thereof inclines forward to a state that the fold portion between side surfaces of the side surface section T (for example, the first fold portion X12 between the first side surface T1 and the second side surface T2) extends vertically. In the present embodiment, the first suction cups 21 contact the corrugated cardboard sheet S and change the orientation of the corrugated cardboard sheet S, but such an arrangement is not provided by way of limitation, and may be configured so that another member contacts the corrugated cardboard sheet S to change the orientation of the corrugated cardboard sheet S.

Figure 9:
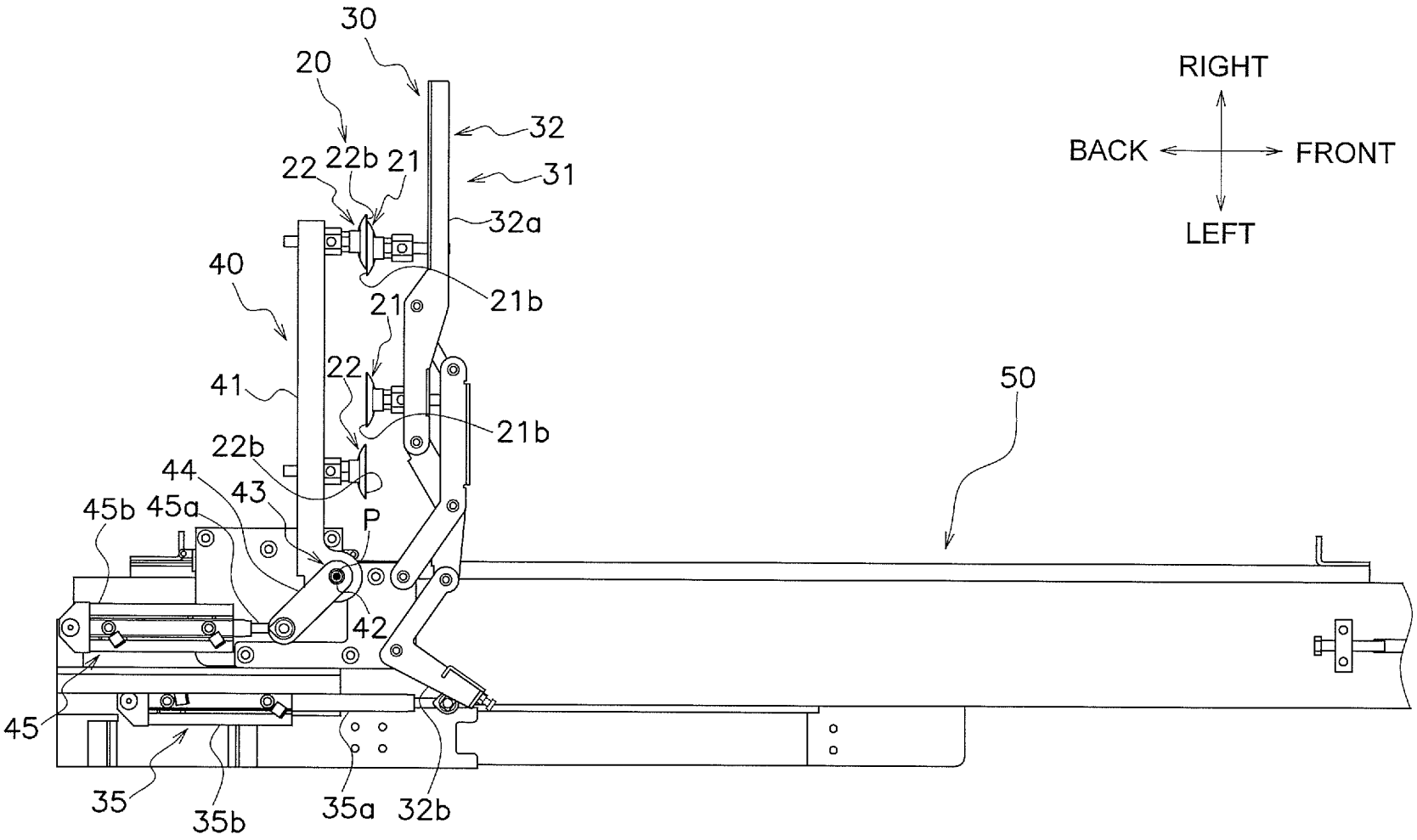
FIG. 9 is a bottom view of the box-opening unit, depicting the box-opening unit of the box-opening device of FIG. 1 and this figure depicts the state of the link mechanism of the first holding part movement mechanism and the arm member of the second holding part movement mechanism when receiving the folded corrugated cardboard sheet (the depiction of the corrugated cardboard sheet is omitted).

The first suction cups 21 are fixed at prescribed positions of the link mechanism 31 of the below-described first holding part movement mechanism 30 (see FIG. 7). The attachment positions of the first suction cups 21 to the link mechanism 31 are determined so that the suction attachment surface 21*b* of each first suction cup 21 abuts an appropriate location of the first side surface T1 of the corrugated cardboard sheet S when the box-opening unit 10 receives the corrugated cardboard sheet S from the sheet supply unit 70. Namely, the attachment positions of the first suction cups 21 to the link mechanism 31 are determined so that the suction attachment surface 21*b* of each first suction cup 21 abuts an appropriate location of the first side surface T1 of the corrugated cardboard sheet S when the first suction cups 21 supported by the link mechanism 31 in an orientation such as that depicted in FIG. 9 are arranged at positions like those depicted in FIG. 9. It is preferable that the attachment positions of the first suction cups 21 to the link mechanism 31 are adjustable so that they can be changed according to the size, etc. of the corrugated cardboard sheet S.

The two first suction cups 21 are attached to the link mechanism 31 so that the first suction cups 21 stick to the first side surface T1 of the corrugated cardboard sheet S at the same height (see FIG. 3B). The positions at which the first suction cups 21 stick to the first side surface T1 are higher than a center position of the first side surface T1 in the height direction. The height positions at which the first suction cups 21 stick to the first side surface T1 are illustrative examples, which are not provided by way of limitation. For example, the attachment positions of the first suction cups 21 in the link mechanism 31, or the shape of the link mechanism 31 may be designed so that two first suction cups 21 stick to the first side surface T1 at mutually different height positions.

The second suction cups 22 hold the second side surface T2 (side surface arranged at the back left side) adjacent to the first side surface T1 of the folded corrugated cardboard sheet S supplied by the sheet supply unit 70 (see FIG. 5A). Each second suction cup 22 keeps holding the second side surface T2 of the corrugated cardboard sheet S without releasing it until the corrugated cardboard sheet S has been opened into a box by the box-opening unit 10 and is then delivered to the bottom lid forming unit 80.

The second suction cups 22 are attached to an arm member 41 of the below-described second holding part movement mechanism 40 (see FIG. 7). When the second suction cups 22 receives the corrugated cardboard sheet S supplied by the sheet supply unit 70, the second suction cups 22 are moved by the arm member 41 from a position (standby position) such as that depicted in FIG. 8, to a position (sheet receiving position) such as that depicted in FIG. 9, so as to contact the second surface side T2 of the corrugated cardboard sheet S from the back (see FIG. 5A).

In the present box-opening device 200, the first suction cups 21 contact the corrugated cardboard sheet S to change the orientation of the corrugated cardboard sheet S as described above, but such an arrangement is not provided by way of limitation. For example, the second suction cups 22 may be configured to contact the second side surface T2 of the corrugated cardboard sheet S to change the orientation of the corrugated cardboard sheet S. For cases in which the second suction cups 22 contact the second side surface T2 to change the orientation of the corrugated cardboard sheet S, the second suction cups 22 preferably contact at positions which are lower than the center position of the second side surface T2 of the corrugated cardboard sheet S in the height direction.

The first suction cups 22 are fixed at prescribed positions of the arm member 41 of the below-described second holding part movement mechanism 40 (see FIG. 7). The attachment positions of the second suction cups 22 to the arm member 41 are determined so that the suction attachment surface 22*b* of each second suction cup 22 abuts an appropriate location of the second side surface T2 of the corrugated cardboard sheet S when the box-opening unit 10 receives the corrugated cardboard sheet S from the sheet supply unit 70. Namely, the attachment positions of the second suction cups 22 to the arm member 41 are determined so that the suction attachment surface 22*b* of each second suction cup 22 abuts an appropriate location of the second side surface T2 of the corrugated cardboard sheet S when the second suction cups 22 supported by the arm member 41 and the below-described bearing 43 in an orientation such as that depicted in FIG. 9 are arranged at positions like those depicted in FIG. 9. The attachment positions of the second suction cups 22 to the link mechanism 31 may be adjustable so that they can be changed according to the size, etc. of the corrugated cardboard sheet S.

The two second suction cups 22 are attached to the arm member 41 so that the second suction cups 22 stick to the second side surface T2 of the corrugated cardboard sheet S at the same height (see FIG. 3A). In addition, the two second suction cups 22 are attached to the arm member 41 so that the second suction cups 22 stick to at a height positions same as those of the two first suction cups 21. The height positions at which the second suction cups 22 stick to the second side surface T2 are illustrative examples, which are not provided by way of limitation. For example, the attachment positions of the second suction cups 22 in the arm member 41, or the shape of the arm member 41 may be designed so that two second suction cups 22 stick to the second side surface T2 at mutually different height positions. Furthermore, the attachment positions of the second suction cups 22 in the arm member 41, or the shape of the arm member 41 may be designed so that two second suction cups 22 stick at height positions that differ from those of the first suction cups 21.

(2-2-1-2) First Holding part Movement Mechanism

The first holding part movement mechanism 30 changes the orientation of the first suction cups 21 with respect to the second suction cups 22, and transforms the corrugated cardboard sheet S to an opened state.

Figure 6:
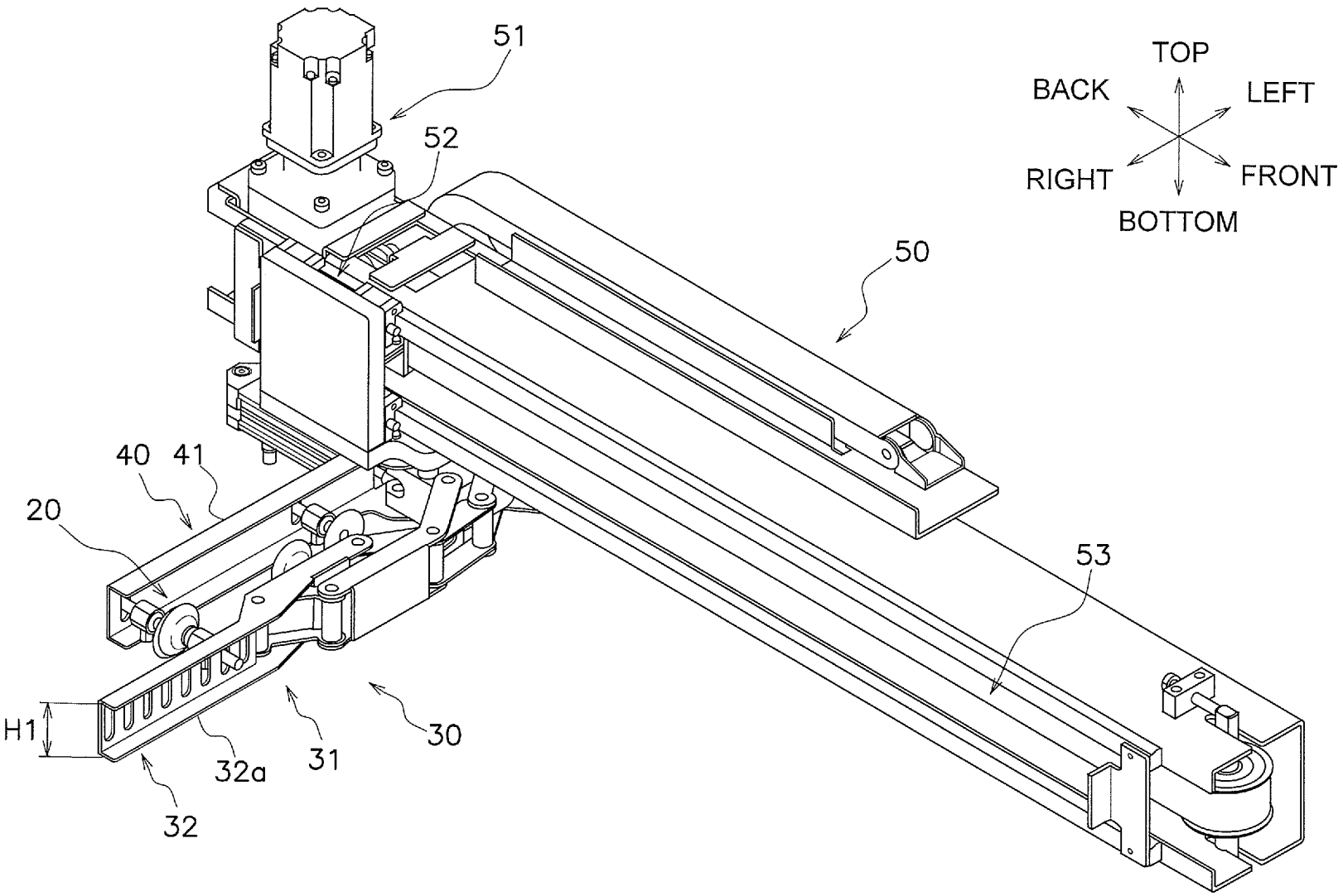
FIG. 6 is a perspective view of the box-opening unit, depicting the box-opening unit of the box-opening device of FIG. 1 as viewed obliquely from above at a forward right position and this figure depicts a state of the link mechanism of the first holding part movement mechanism and the arm member of the second holding part movement mechanism when receiving the folded corrugated cardboard sheet (the depiction of the corrugated cardboard sheet is omitted).

The first holding part movement mechanism 30 primarily includes a link mechanism 31 and a link mechanism drive unit 35 (see FIGS. 4 and 6). The first holding part movement mechanism 30 is attached to a holding part movement mechanism support part 52 of a below-described movement mechanism 50 that is configured so as to be movable in the longitudinal direction, and is supported by the holding part movement mechanism support part 52 (see FIG. 7).

The link mechanism drive unit 35 is connected to the link mechanism 31, and drives the link mechanism 31. The link mechanism drive unit 35 is an air cylinder (see FIG. 8). The link mechanism drive unit 35 moves a rod 35*a* so that the rod 35*a* exits from a cylinder 35*b* or the rod 35*a* enters the cylinder 35*b*, and thereby drives the link mechanism 31 to which the rod 35*a* is coupled (see FIGS. 8 and 9). The link mechanism drive unit 35 is not limited to an air cylinder, and for example, may be a motor.

The link mechanism 31 is one example of the support member. The link mechanism 31 has a plurality of links 32, and each link 32 is connected to another link through a joint (movable portion). In the present embodiment, as illustrated in FIG. 9 for example, five links 32 are connected by joints. The five links include a suction cup attachment link 32*a* to which two first suction cups 21 are attached, and a driven link 32*b* to which the rod 35*a* of the link mechanism drive unit 35 is connected. The link mechanism 31 illustrated in the present embodiment is merely one example of a specific configuration of the link mechanism, and is not limited to such a configuration. The link mechanism 31 may be configured so that the first suction cups 21 attached to the link mechanism can be operated in a manner described below.

Figure 8:
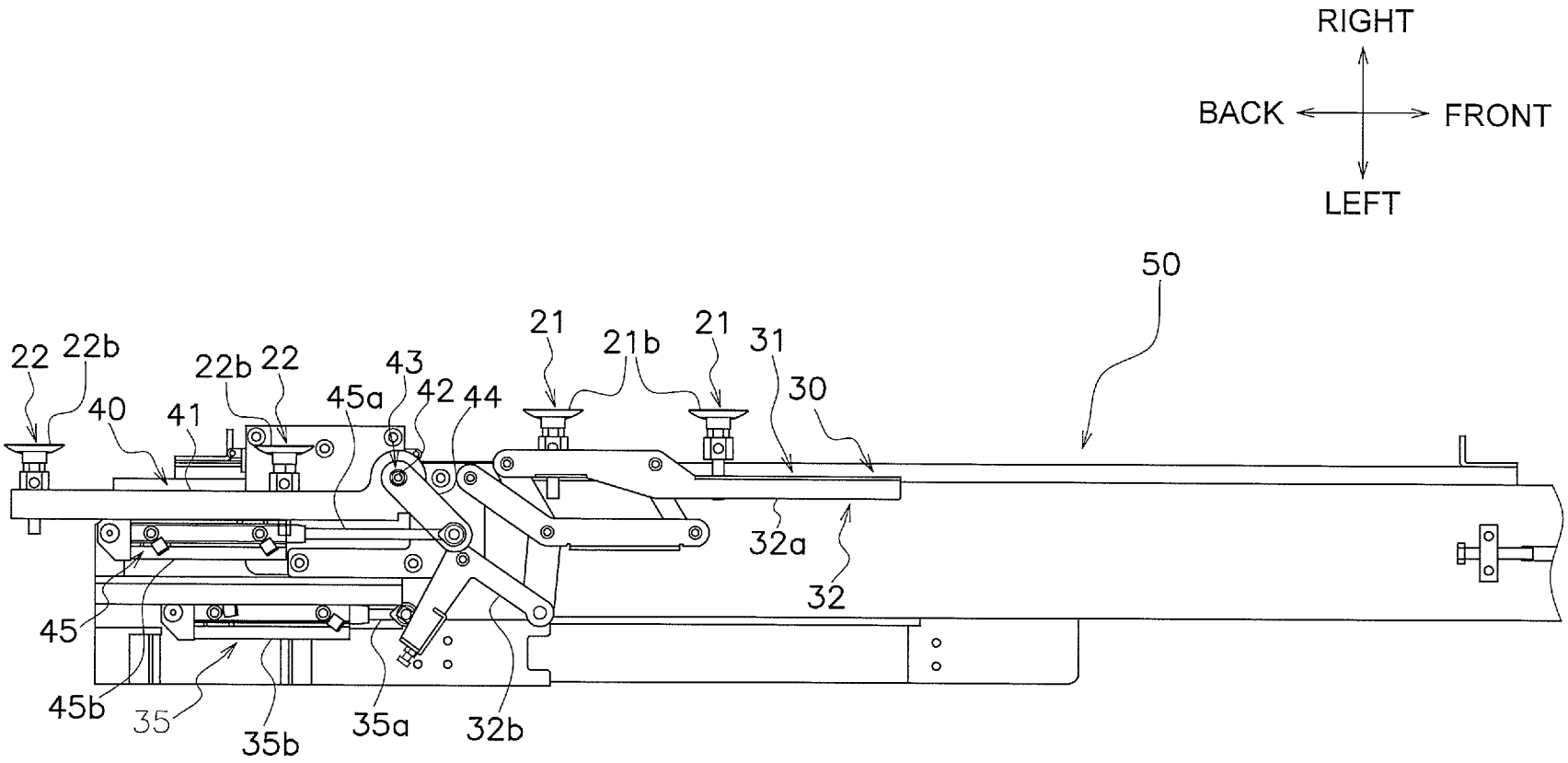
FIG. 8 is a bottom view of the box-opening unit, depicting the box-opening unit of the box-opening device of FIG. 1 and this figure depicts the state of the link mechanism of the first holding part movement mechanism and the arm member of the second holding part movement mechanism before receiving the folded corrugated cardboard sheet.
Figure 10:
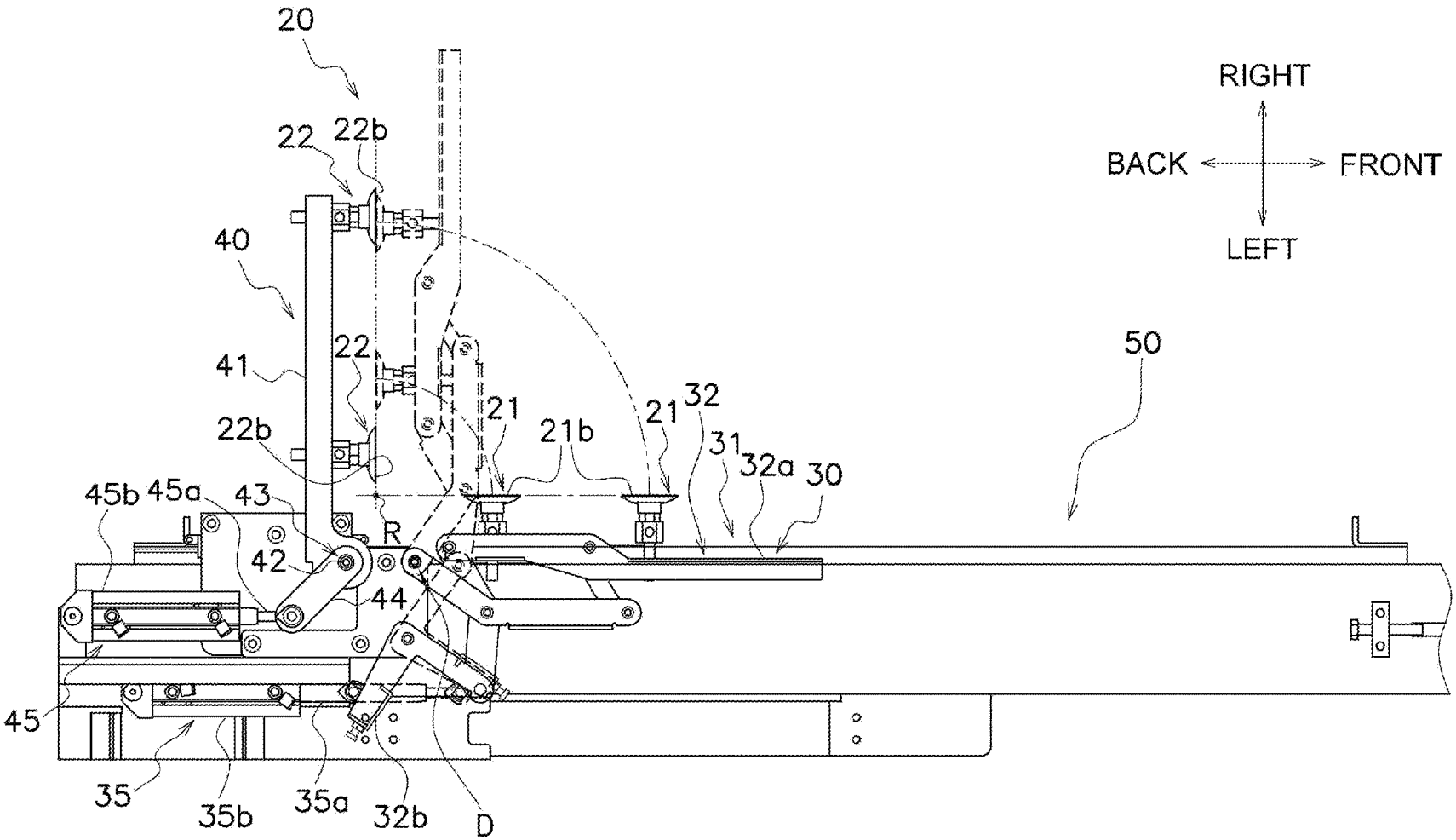
FIG. 10 is a bottom view of the box-opening unit, depicting the box-opening unit of the box-opening device of FIG. 1 and this figure depicts the state of the link mechanism of the first holding part movement mechanism and the arm member of the second holding part movement mechanism when opening of the corrugated cardboard sheet into a box has been completed (the depiction of the corrugated cardboard sheet is omitted).

The link mechanism 31 is configured so that it can change its state between a first state such as that depicted in FIGS. 8 and 10, and a second state such as that depicted in FIG. 9 by rotating around a drive axis D. In the first state, the suction attachment surfaces 21*b* of the first suction cups 21 attached to the suction cup attachment link 32*a* are oriented to the right, and the two first suction cups 21 are aligned in the front-back direction. In the second state, the suction attachment surfaces 21*b* of the first suction cups 21 attached to the suction cup attachment link 32*a* are oriented to the back, and the two first suction cups 21 are aligned in the left-right direction.

When the box-opening unit 10 opens the corrugated cardboard sheet S, the rod 35*a* of the link mechanism drive unit 35 is driven so as to enter the cylinder 35*b*, and the state of the link mechanism 31 changes from the second state to the first state (see FIGS. 9 and 10). When the box-opening unit 10 opens the corrugated cardboard sheet S, the arm member 41 of the second holding part movement mechanism 40 is not moved, and the position of the second suction cup 22 does not change. That is, when the box-opening unit 10 opens the corrugated cardboard sheet S, the first holding part movement mechanism 30 changes, with respect to the second suction cups 22, the position of the first suction cups 21 attached to the suction cup attachment link 32*a* of the link mechanism 31. In other words, when the box-opening unit 10 opens the corrugated cardboard sheet S, the first holding part movement mechanism 30 changes, with respect to the second suction cups 22, the positional relationship of the first suction cups 21 attached to the suction cup attachment link 32*a* of the link mechanism 31. In addition, when the box-opening unit 10 opens the corrugated cardboard sheet S, the first holding part movement mechanism 30 changes, with respect to the second suction cups 22, the direction in which the suction attachment surfaces 21*b* of the first suction cups 21 are oriented.

When the state of the link mechanism 31 is changed from the second state to the first state in order for the box-opening unit 10 to open the corrugated cardboard sheet S, each first suction cup 21 rotates on an arc track about a central axis of rotation R that overlaps an imaginary line IL (see FIG. 2) extending along a boundary line A between the first side surface T1 and the second side surface T2 of the corrugated cardboard sheet S which is opened by the box-opening unit 10 (see FIG. 10). When the state of the link mechanism 31 is changed from the second state to the first state, each first suction cup 21 rotates approximately 90 degrees about the central axis of rotation R (see FIG. 10). As illustrated in FIG. 2, the boundary line A between the first side surface T1 and the second side surface T2 is a line that overlaps the first fold portion X12, which is the boundary between the first side surface T1 and the second side surface T2. More specifically, for example, a center 21*a* of the circular first suction cup 21 (see FIG. 7) rotates on an arc track as depicted by the two-dot chain line in FIG. 10, about the central axis of rotation R, which overlaps the imaginary line IL that extends along the boundary line A between the first side surface T1 and the second side surface T2 of the corrugated cardboard sheet S that which is opened by the box-opening unit 10. In other words, the link mechanism 31 supports the first suction cups 21 so that the first suction cups 21 rotate on an arc track about the central axis of rotation R that overlaps the imaginary line IL extending along the boundary line A between the first side surface T1 and the second side surface T2 of the corrugated cardboard sheet S which is opened by the box-opening unit 10. During rotation of the first suction cups 21, the central axis of rotation R is immobile. Also, during rotation of the first suction cups 21, a distance between the central axis of rotation R and the first suction cup 21 (for example, the distance between the central axis of rotation R and the center 21*a* of the circular first suction cup 21) is constant.

Furthermore, when the rod 35*a* of the link mechanism drive unit 35 is driven so as to exit from the cylinder 35*b* the state of the link mechanism 31 is changed from the first state to the second state (see FIGS. 8 and 9), the link mechanism 31 supports the first suction cups 21 so that the first suction cups 21 rotate on an arc track about the central axis of rotation R that overlaps the imaginary line IL extending along the boundary line A between the first side surface T1 and the second side surface T2 of the corrugated cardboard sheet S which is opened by the box-opening unit 10.

In the extension direction (vertical direction in the present embodiment) of the boundary line A of the corrugated cardboard sheet S that is opened by the first holding part movement mechanism 30, the link mechanism 31 is disposed within a positional range at which the boundary line A is present. In other words, as illustrated in FIG. 3B, a vertical direction height H1 of the link mechanism 31 is less than a vertical height Hs of the corrugated cardboard sheet S to be opened by the first holding part movement mechanism 30. The height Hs is a length from the end part of the top lid side flaps F2 of the corrugated cardboard sheet S to the end part of the bottom lid side flaps F1. Furthermore, as in FIG. 3B, the vertical direction height H1 of the link mechanism 31 is less than a vertical direction height Ht of the side surface section T of the corrugated cardboard sheet S to be opened by the first holding part movement mechanism 30. Furthermore, the entire link mechanism 31 is arranged between the upper end and the lower end of the side surface section T of the corrugated cardboard sheet S to be opened by the first holding part movement mechanism 30. With such a configuration, the upper end position of the box-opening unit 10 can be restricted to be lower than the upper end position of the corrugated cardboard sheet S supplied to the box-opening unit 10, and the size of the box-opening unit 10 in the height direction can be suppressed.

(2-2-1-3) Second Holding Part Movement Mechanism

The second holding part movement mechanism 40 rotates the second suction cups 22 about a prescribed rotation axis P (see FIG. 9).

The second holding part movement mechanism 40 includes primarily the arm member 41, a turning shaft 42 coupled to the arm member 41, a bearing 43 that rotatably supports the turning shaft 42, a link 44, and an arm drive unit 45 (see FIGS. 4 and 8). The second holding part movement mechanism 40 is attached to the holding part movement mechanism support part 52 of the below-described movement mechanism 50 that is configured to be movable in the front-back direction, and is supported by the holding part movement mechanism support part 52 (see FIG. 7).

The bearing 43 rotatably supports the turning shaft 42 coupled to the arm member 41, and thereby rotatably supports the arm member 41.

The arm drive unit 45 is connected to the turning shaft 42 that is coupled to the arm member 41 through the link 44, and drives the arm member 41. The arm drive unit 45 is an air cylinder (see FIG. 8). The arm drive unit 45 moves the rod 45*a* so that the rod 45*a* exits from the cylinder 45*b* or the rod 45*a* enters the cylinder 45*b*, and thereby drives the arm member 41 that is coupled to the rod 45*a* through the link 44 (see FIGS. 8 and 9). The link 44 is an elongated flat plate shaped member with one end side in the elongated direction coupled to the arm member 41 and the other end side in the elongated direction coupled to the rod 45*a*. The arm drive unit 45 is not limited to an air cylinder, and for example, may be a motor.

The arm member 41 is a member elongating in the horizontal direction and formed in a U-shape in cross-section (see FIG. 7). Two second suction cups 22 are attached to the arm member 41 along the elongating direction thereof (see FIG. 7).

The arm member 41 is configured so that it can change its state between a first state such as that depicted in FIG. 8, and a second state such as that depicted in FIGS. 9 and 10. In the first state, the suction attachment surfaces 22*b* of the second suction cups 22 attached to the arm member 41 are oriented to the right, and the two second suction cups 22 are aligned in the front-back direction. In the second state, the suction attachment surfaces 22*b* of the second suction cups 22 attached to the arm member 41 are oriented to the front, and the two second suction cups 22 are aligned in the left-right direction.

When the rod 45*a* of the arm drive unit 45 is driven so as to enter the cylinder 45*b*, the arm member 41 rotates about the central turning axis of the turning shaft 42 that is rotatably supported by the bearing 43, and the state of the arm member 41 changes from the first state to the second state. In addition, when the rod 45*a* of the arm drive unit 45 is driven so as to exit from the cylinder 45*b*, the arm member 41 rotates about the central turning axis of the turning shaft 42 that is rotatably supported by the bearing 43, and the state of the arm member 41 changes from the second state to the first state. When the state of the arm member 41 changes from the first state to the second state, or from the second state to the first state, the second suction cups 22 rotate approximately 90 degrees about the rotation axis P that overlaps the central turning axis of the bearing 43 (see FIGS. 8 to 10). In other words, the second holding part movement mechanism 40 rotates the second suction cups 22 about the rotation axis P.

(2-2-1-4) Movement Mechanism

The movement mechanism 50 is a mechanism that moves the first holding part movement mechanism 30 and the second holding part movement mechanism 40 in the front-back direction. The movement mechanism 50 moves the tubular corrugated cardboard box TB by moving the first holding part movement mechanism 30 and the second holding part movement mechanism 40 while holding the tubular corrugated cardboard box TB with the first suction cups 21 and the second suction cups 22.

The movement mechanism 50 includes primarily a belt drive unit 51, the holding part movement mechanism support part 52, and a belt mechanism 53.

The first holding part movement mechanism 30 and the second holding part movement mechanism 40 are attached to the holding part movement mechanism support part 52. The holding part movement mechanism support part 52 is a member that supports the first holding part movement mechanism 30 and the second holding part movement mechanism 40. The holding part movement mechanism support part 52 is coupled to the belt mechanism 53 that functions as a power transmission mechanism. When the belt mechanism 53 is driven by the belt drive unit 51, the holding part movement mechanism support part 52 moves forward and backward along the direction in which the belt of the belt mechanism 53 extends. When the holding part movement mechanism support part 52 is moved in the front-back direction, the first holding part movement mechanism 30 and the second holding part movement mechanism 40 attached to the holding part movement mechanism support part 52 also move in the front-back direction. Furthermore, when the holding part movement mechanism support part 52 is moved in the front-back direction, the corrugated cardboard sheet S (including a corrugated cardboard sheet S in the opened state), held by the first suction cups 21 attached to the first holding part movement mechanism 30 and the second suction cups 22 attached to the second holding part movement mechanism 40, moves in the front-back direction.

More specifically, the movement mechanism 50 moves the holding part movement mechanism support part 52 forward with the belt mechanism 53, and thereby moves the corrugated cardboard sheet S (tubular corrugated cardboard box TB), which has been opened by the first holding part movement mechanism 30, forward to the bottom lid forming unit 80. Furthermore, after the tubular corrugated cardboard box TB has been delivered to the bottom lid forming unit 80, the movement mechanism 50 moves the holding part movement mechanism support part 52 rearward with the belt mechanism 53, and thereby moves the first holding part movement mechanism 30 and the second holding part movement mechanism 40 rearward. More specifically, after delivering the tubular corrugated cardboard box TB to the bottom lid forming unit 80, the movement mechanism 50 moves the holding part movement mechanism support part 52, which supports the first holding part movement mechanism 30 and the second holding part movement mechanism 40, rearward so that first suction cups 21 and the second suction cups 22 return to the position for receiving the corrugated cardboard sheet S supplied from the sheet supply unit 70.

In the following description, the position at which the holding part movement mechanism support part 52 is arranged in order to arrange the first suction cups 21 and the second suction cups 22 at the position for receiving a corrugated cardboard sheet S supplied from the sheet supply unit 70 is referred to as the first position. Furthermore, the position at which the holding part movement mechanism support part 52 is arranged when delivering the tubular corrugated cardboard box TB to the bottom lid forming unit 80 is referred to as the second position.

(2-3) Control Unit

The control unit 60 is one example of a control unit for controlling the box-opening device 200. In the present embodiment, the control unit 60 controls not only the operation of the box-opening unit 10 of the box-opening device 200, but also the operations of the sheet supply unit 70, the bottom lid forming unit 80, and the box supply unit 90.

As illustrated in FIG. 4, the control unit 60 is electrically connected to each constituent element of the box-opening unit 10 including the first suction drive unit 23, the second suction drive unit 24, the link mechanism drive unit 35, the arm drive unit 45, and the belt drive unit 51. The control unit 60 is also electrically connected to the sheet supply unit 70, the bottom lid forming unit 80 and the box supply unit 90.

As illustrated in FIG. 4, the control unit 60 primarily includes a storage unit 61 and a control part 62.

(2-3-1) Storage Unit

The storage unit 61 is configured from ROM, RAM, and a hard disk drive (HDD) and so on. For example, various programs executed by the control part 62 are stored in the storage unit 61. In addition, for example, various types of information, such as various parameters for control, necessary for the control part 62 to control the box manufacturing system 100 are stored in the storage unit 61.

(2-3-2) Control Part

The control part 62 is configured primarily from a CPU/CPUs. The control part 62 reads and executes a program/programs stored in the storage unit 61, and controls the operation of each constituent element of the box-opening unit 10 including the first suction drive unit 23, the second suction drive unit 24, the link mechanism drive unit 35, the arm drive unit 45, and the belt drive unit 51. The control part 62 also reads and executes a program/programs stored in the storage unit 61 to control the sheet supply unit 70, the bottom lid forming unit 80 and the box supply unit 90.

As a control of the box-opening unit 10, the control unit 60 controls, for example, the operations of the first suction drive unit 23 and the second suction drive unit 24 in order to switch between holding and releasing of the side surface section T of the corrugated cardboard sheet S by the first suction cups 21 and the second suction cups 22. In addition, for example, the control unit 60 controls the operations of the link mechanism drive unit 35 and the arm drive unit 45 in order to change the position (orientation) of the first suction cups 21 and the second suction cups 22. The control unit 60 also controls the operation of the belt drive unit 51 in order to deliver the corrugated cardboard sheet S (tubular corrugated cardboard box TB) in an opened state to the bottom lid forming unit 80. The specific control of the operation of the box-opening unit 10 by the control unit 60 will be described later.

Figure 11:
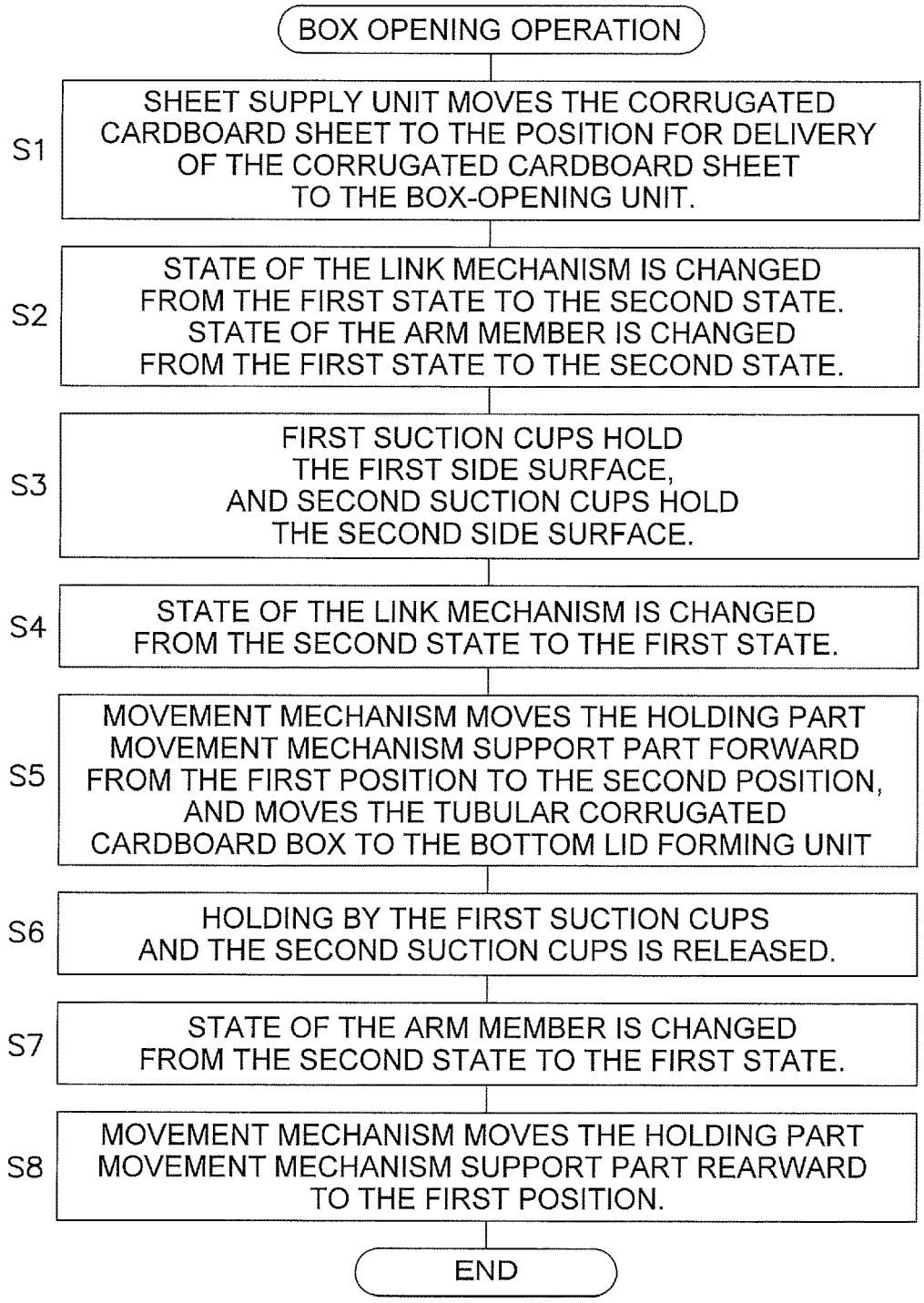
FIG. 11 is a flowchart for describing the box-opening operation of the box-opening device of FIG. 1.

(3) Operation for Opening the Corrugated Cardboard Sheet into a Box by the Box-Opening Device The operation for opening the corrugated cardboard sheet S into a box using the box-opening device 200 is described while referencing the flowchart of FIG. 11. The box-opening operation described below is merely one example, and it is not limited thereto.

First, the state of each constituent element of the box-opening unit 10 before the box-opening operation is started (before the corrugated cardboard sheet S is supplied by the sheet supply unit 70) is described. Before the box-opening operation is started, the holding part movement mechanism support part 52 is arranged at the above-described first position. The link mechanism 31 is in the above-described first state. The arm member 41 is in the abovementioned first state. That is, before the box-opening operation is started, the box-opening unit 10 is in a state such as that depicted in FIG. 8.

At first, in step 51, the sheet supply unit 70 that is controlled by the control unit 60 supplies a corrugated cardboard sheet S to the box-opening unit 10 as a preliminary step for the box-opening operation of the box-opening device 200. That is, in step S1, the sheet supply unit 70 controlled by the control unit 60 moves the corrugated cardboard sheet S to the position at which the corrugated cardboard sheet S is handed over to the box-opening unit 10.

Next, in step S2, the control unit 60 controls the link mechanism drive unit 35 of the first holding part movement mechanism 30, and changes the state of the link mechanism 31 from the first state to the second state (see FIG. 9). As a result, the first suction cups 21 attached to the link mechanism 31 contact the first side surface T1 of the corrugated cardboard sheet S from the forward side, and the orientation of the corrugated cardboard sheet S is changed (so that the corrugated cardboard sheet S is in a vertically extended state). Also, in step S2, the control unit 60 controls the arm drive unit 45 of the second holding part movement mechanism 40, and changes the state of the arm member 41 from the first state to the second state (see FIG. 9). As a result, the second suction cups 22 attached to the arm member 41 contact the second side surface T2 of the corrugated cardboard sheet S from the rearward side. The timing of the operation of the link mechanism 31 and the arm member 41 is appropriately determined so that a state is formed in which the corrugated cardboard sheet S is sandwiched by the first suction cups 21 and the second suction cups 22 (see FIG. 5A).

Next, in step S3, the control unit 60 operates the first suction drive unit 23 and the second suction drive unit 24 so that the first suction cups 21 stick and hold the first side surface T1 of the corrugated cardboard sheet S, and the second suction cups 22 stick and hold the second side surface T2 of the corrugated cardboard sheet S. Note that the timing of the step S2 and timing of the step S3 may be partially or entirely overlapped.

Figure 5B:
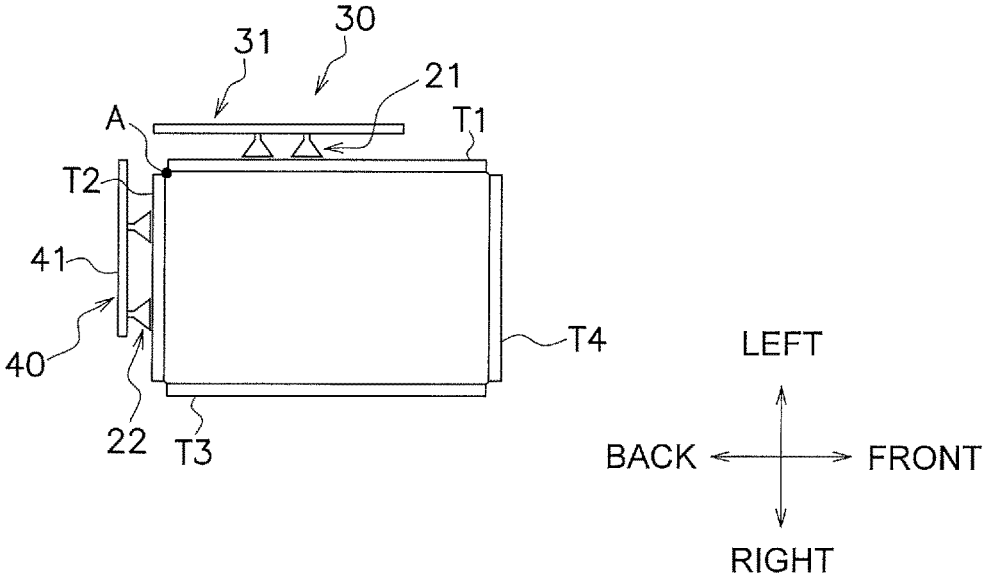
FIG. 5B is a schematic plan view that schematically depicts the state that the box-opening unit of the box-opening device in the box manufacturing system of FIG. 1 has opened the corrugated cardboard sheet supplied from the sheet supply unit and this figure omits the depiction of the flaps of the corrugated cardboard sheet.

Next, in step S4, the control unit 60 controls the link mechanism drive unit 35 of the first holding part movement mechanism 30, and changes the state of the link mechanism 31 from the second state to the first state (see FIG. 10). As a result, the first suction cups 21 attached to the link mechanism 31 rotate on an arc track about the central axis of rotation R that overlaps the imaginary line IL (see FIG. 2) extending along the boundary line A between the first side surface T1 and the second side surface T2 of the corrugated cardboard sheet S that the first holding part movement mechanism 30 is going to open (see FIG. 10). As a result, as illustrated in FIG. 5B, the corrugated cardboard sheet S comes to an opened state. Because the first suction cups 21 rotates on an arc track about the central axis of rotation R as shown above, only a force necessary to open the first side surface T1 with respect to the second side surface T2 around the first fold portion X12 acts on the first side surface T1 that is held by the first suction cups 21. In other words, because the first suction cups 21 rotates on an arc track about the central axis of rotation R, a force in a direction orthogonal to the suction attachment surfaces 21*b* of the first suction cups 21 is less susceptible to act the first side surface T1 that is held by the first suction cups 21. As a result, the corrugated cardboard sheet S can be reliably opened into a box without being damaged or deformed.

Next, in step S5, the control unit 60 operates the belt drive unit 51, and moves the holding part movement mechanism support part 52 forward from the first position to the second position. As a result, the first holding part movement mechanism 30 and the second holding part movement mechanism 40 attached to the holding part movement mechanism support part 52 also move forward. Furthermore, the tubular corrugated cardboard box TB that is held by the first suction cups 21, supported by the link mechanism 31 of the first holding part movement mechanism 30 and by the second suction cups 22 supported by the arm member 41 of the second holding part movement mechanism 40, is moved to the bottom lid forming unit 80.

Next, in step S6, the control unit 60 stops the operation of the first suction drive unit 23 and the second suction drive unit 24 so that holding of the corrugated cardboard sheet S by the first suction cups 21 and the second suction cups 22 is canceled. As a result, the tubular corrugated cardboard box TB is delivered to the bottom lid forming unit 80.

Next, in step S7, the control unit 60 controls the arm drive unit 45 of the second holding part movement mechanism 40, and changes the state of the arm member 41 from the second state to the first state.

Next, in step S8, the control unit 60 operates the belt drive unit 51, and moves the holding part movement mechanism support part 52 rearward from the second position to the first position.

The order of step S7 and step S8 may be reversed, or step S7 and step S8 may be simultaneously executed.

The abovementioned steps S1 to S8 are executed to each of the corrugated cardboard sheets S.

(4) Characteristics (4-1)

The box-opening device 200 according to the abovementioned embodiment is provided with the first suction cups 21 as an example of the first holding part, the second suction cups 22 as an example of the second holding part, and the first holding part movement mechanism 30. The first suction cups 21 hold the first side surface T1, which is one of two adjacent surfaces (the first side surface T1 and the second side surface T2) of the folded corrugated cardboard sheet S. The second suction cups 22 hold the second side surface T2, which is the other of the two adjacent surfaces of the corrugated cardboard sheet S. The first holding part movement mechanism 30 changes the position of the first suction cups 21 with respect to the second suction cups 22 and thereby transforms the corrugated cardboard sheet S to an opened state. That is, the first holding part movement mechanism 30 changes the position of the first suction cups 21 with respect to the second suction cups 22 and opens the corrugated cardboard sheet S to form the tubular corrugated cardboard box TB. The first holding part movement mechanism 30 has the link mechanism 31 as one example of the support member. The link mechanism 31 supports the first suction cups 21 so that the first suction cups 21 rotate on an arc track about the central axis of rotation R that overlaps the imaginary line IL extending along the boundary line A between the first side surface T1 and the second side surface T2 of the corrugated cardboard sheet S.

In the box-opening device illustrated in FIG. 5 of patent document 1 (Japanese Laid-open Patent Application No. 2000-6909), the central axis of rotation of a first suction pad that holds one of two adjacent surfaces of a corrugated cardboard sheet and is rotated to transform the corrugated cardboard sheet into an opened state, is not aligned with the boundary line (fold portion) between the two adjacent surfaces of the corrugated cardboard sheet. With the box-opening device illustrated in FIG. 5 of patent document 1 (Japanese Laid-open Patent Application No. 2000-6909), the fold portion between two adjacent surfaces of the corrugated cardboard sheet is arranged near a second suction pad that is separate from the central axis of rotation of the first suction pad and holds a surface that differs from a surface held by the first suction pad that is rotated in order to transform the corrugated cardboard sheet to an opened state. With such a configuration, the surface held by the rotating first suction pad cannot smoothly turn about the fold portion with respect to the surface held by the second suction pad. In other words, in the box-opening device disclosed by the patent document 1 (Japanese Laid-open Patent Application No. 2000-6909), on the surface of the corrugated cardboard sheet held by the first suction pad, a force is also applied in a direction (radial direction with respect to the boundary line (fold portion) as the central axis) that is different from the direction (circumferential direction about the boundary line as the central axis) in which the force should be applied to open the corrugated cardboard sheet into a box. Therefore, with the box-opening device of patent document 1 (Japanese Laid-open Patent Application No. 2000-6909), according to the characteristics and state of the corrugated cardboard sheet, problems, such that the corrugated cardboard sheet (corrugated cardboard box) is damaged or deformed during the sheet is opened into a box, or opening the sheet into a box is failed due to release of the holding of the corrugated cardboard sheet at an unintended timing, may occur. These types of problems tend to occur particularly in cases, for example, in which the corrugated cardboard sheet is thin and its strength is relatively low, and in which recycled corrugated cardboard sheets are used.

In contrast, with the box-opening device 200 according to the present embodiment, a force can be applied on the first side surface T1 of the corrugated cardboard sheet S held by the first suction cups 21, solely in the direction (circumferential direction with respect to the fold portion X12 as the center axis) in which a force should be applied to open the sheet into a box. Therefore, the box-opening device 200 according to the present embodiment can reliably open the corrugated cardboard sheet S into a box without damaging or deforming the corrugated cardboard sheet S regardless of the characteristics and state of the corrugated cardboard sheet S.

(4-2)

With the box-opening device 200 according to the abovementioned embodiment, the central axis of rotation R is immobile during rotation of the first suction cups 21. With the box-opening device 200 according to the abovementioned embodiment, it is easy to apply a force on the first side surface T1 of the corrugated cardboard sheet S solely in the direction in which the force should be applied to open the corrugated cardboard sheet S into a box, and it is therefore easy to reliably open the corrugated cardboard sheet S into a box without damaging or deforming the corrugated cardboard sheet S regardless of the characteristics and state of the corrugated cardboard sheet S.

(4-3)

With the box-opening device 200 according to the abovementioned embodiment, the distance between the central axis of rotation R and the first suction cups 21 is constant during rotation of the first suction cups 21. For example, during rotation of the first suction cup 21, a distance between the central axis of rotation R and the center 21*a* (see FIG. 7) of a circular first suction cup 21 as a representative point of the first suction cup 21 is constant.

With the box-opening device 200 according to the abovementioned embodiment, it is easy to apply a force on the first side surface T1 of the corrugated cardboard sheet S solely in the direction in which the force should be applied to open the corrugated cardboard sheet S into a box, and it is therefore easy to reliably open the corrugated cardboard sheet S into a box without damaging or deforming the corrugated cardboard sheet S regardless of the characteristics and state of the corrugated cardboard sheet S.

(4-4)

With the box-opening device 200 according to the abovementioned embodiment, the link mechanism 31 is disposed within a positional range at which the boundary line A is present, in the extension direction of the boundary line A between the first side surface T1 and the second side surface T2 of the corrugated cardboard sheet S that is opened by the first holding part movement mechanism 30.

With the box-opening device 200 according to the abovementioned embodiment, in the extension direction (vertical direction here) of the boundary line A of the corrugated cardboard sheet S that is opened into a box, the link mechanism 31 is disposed within a positional range (height position) at which the boundary line A is present. Therefore, the box-opening device 200 (box-opening unit 10) can be made more compact in the direction along which the boundary line A of the opened corrugated cardboard sheet S extends.

(4-5)

With the box-opening device 200 according to the abovementioned embodiment, the second holding part movement mechanism 40 that rotates the second suction cups 22 about the prescribed rotation axis P is provided.

With the box-opening device 200 according to the abovementioned embodiment, the second suction cups 22 can also be rotated, and the second suction cups 22 can be moved with respect to the corrugated cardboard sheet S. More specifically, with the present box-opening device 200, the second suction cups 22 that are not contacting the corrugated cardboard sheet S can be rotated by the second holding part movement mechanism 40, and moved to positions at which the second suction cups 22 can hold the second side surface T2 of the corrugated cardboard sheet S (positions at which the suction attachment surfaces 22*b* of the second suction cups 22 contact the second side surface T2). Therefore, with the box-opening device 200 according to the abovementioned embodiment, the corrugated cardboard sheet S to be supplied to the box-opening device 200 can be reliably held by the first suction cups 21 and the second suction cups 22.

Second Embodiment

A box-opening device 200 according to a second embodiment of the present invention is described below while referencing FIGS. 12 and 13. The box-opening device 200 according to the second embodiment is the same as the box-opening device 200 according to the first embodiment with the exception that a first holding part movement mechanism 130 is used in place of the first holding part movement mechanism 30 of the box-opening unit 10. Therefore, with the exception of a description of the first holding part movement mechanism 130, a description of the box-opening device 200 according to the second embodiment is omitted.

Figure 12:
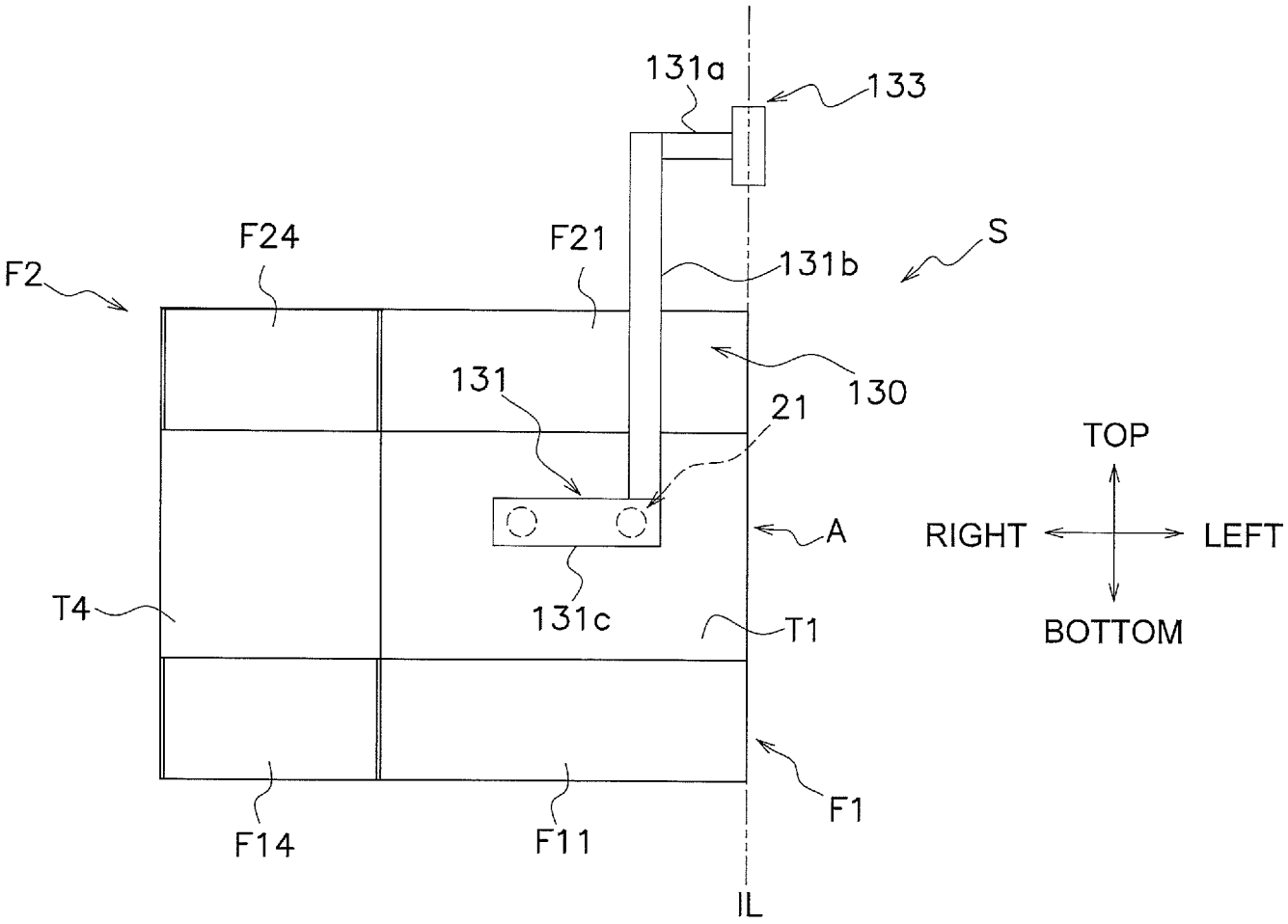
FIG. 12 is a schematic front view that schematically depicts the state that a box-opening unit of a box-opening device according to a second embodiment has received the folded corrugated cardboard sheet supplied from the sheet supply unit.

FIG. 12 is a schematic front view that schematically depicts a state in which the box-opening unit 10 has received the folded corrugated cardboard sheet S supplied from the sheet supply unit 70. In FIG. 12, the first holding part movement mechanism 130 is schematically depicted. FIG. 13 is a schematic plan view that schematically depicts the first holding part movement mechanism 130.

With the box-opening device 200 of the first embodiment, the link mechanism 31 supports the first suction cups 21 so that the first suction cups 21 rotates on an arc around track about the central axis of rotation R that overlaps the imaginary line IL that extends along the boundary line A between the first side surface T1 and the second side surface T2 of the corrugated cardboard sheet S.

In contrast, the box-opening device 200 of the second embodiment has a first holding part movement mechanism 130 in place of the first holding part movement mechanism 30 of the first embodiment. Similar to the second holding part movement mechanism 40 of the first embodiment, the first holding part movement mechanism 130 includes primarily an arm member 131, a turning shaft 132 coupled to the arm member 131, a bearing 133 that rotatably supports the turning shaft 132, a link (not illustrated), and an arm drive unit (not illustrated) (see FIGS. 12 and 13). The arm member 131 and the turning shaft 132 may be integrally formed. The arm member 131, the turning shaft 132, and the bearing 133 configure a support member 135 (see FIG. 13). Similar to the first embodiment, the first holding part movement mechanism 130 is attached to the holding part movement mechanism support part 52 of the movement mechanism 50 that is configured to be movable in the front-back direction, and is supported by the holding part movement mechanism support part 52.

The bearing 133 rotatably supports the turning shaft 132 coupled to the arm member 131, and thereby rotatably supports the arm member 131. The central turning axis of the bearing 133, or in other words, the central turning axis of the turning shaft 132 that is supported by the bearing 133, is arranged on an imaginary line IL extending along the boundary line A between the first side surface T1 and the second side surface T2 of the corrugated cardboard sheet S to be opened by the first holding part movement mechanism 130. In order to avoid contact with the corrugated cardboard sheet S that is opened by the first holding part movement mechanism 130, the bearing 133 is arranged at a position that is higher than the upper end of the corrugated cardboard sheet S (upper end of the top lid side flaps F2 of the corrugated cardboard sheet S) (see FIG. 12).

Driving of the arm member 131 by the arm drive unit is implemented in the same manner as the driving of the arm member 41 by the arm drive unit 45 in the second holding part movement mechanism 40 of the first embodiment, and therefore a description is omitted here.

Figure 13:
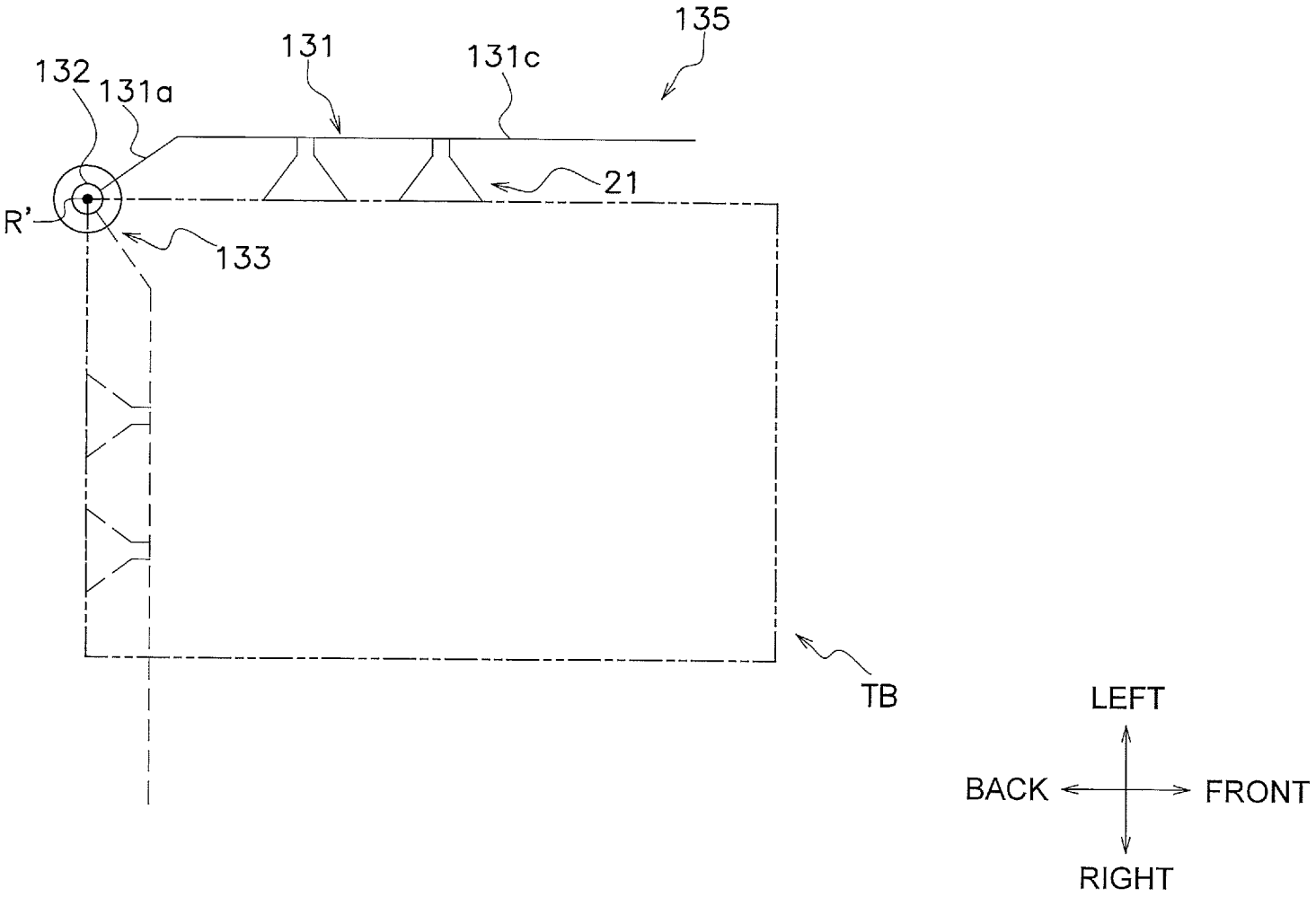
FIG. 13 is a schematic plan view that schematically depicts a support member of the first holding part movement mechanism of the box-opening unit of the box-opening device of FIG. 12.

The arm member 131 according to the present embodiment includes a first portion 131*a* extending horizontally from the turning shaft, a second portion 131*b* extending downward from the first portion 131*a*, and a third portion 131*c* extending horizontally from a lower end of the second portion 131*b* (see FIGS. 12 and 13). Two first suction cups 21 are attached to the horizontally extending third portion 131*c* of the arm member 131 along the longitudinal direction (see FIGS. 12 and 13). The shape of the arm member 131 is given as an example, and the shape is not limited thereto.

The arm member 131 rotates about the central turning axis of the turning shaft 132 that is rotatably supported by the bearing 133, and thereby the first suction cups 21 attached to the third portion 131*c* of the arm member 131 rotate about a central axis of rotation R' that overlaps the central turning axis of the turning shaft 132 (see FIG. 13). That is, in the box-opening device 200 according to the second embodiment, the support member 135 of the first holding part movement mechanism 130 supports the first suction cups 21 so that the first suction cups 21 rotate on an arc track about the central axis of rotation R' that overlaps the imaginary line IL extending along the boundary line A between the first side surface T1 and the second side surface T2 of the corrugated cardboard sheet S. The central axis of rotation R' is immobile during rotation of the first suction cups 21. Also, during rotation of the first suction cups 21, the distance between the central axis of rotation R' and the first suction cup 21 (for example, the distance between the central axis of rotation R' and the center 21*a* of a circular first suction cup 21) is constant.

The box-opening device 200 of the second embodiment has the same characteristics as the characteristics (4-1) to (4-3) and (4-5) of the box-opening device 200 of the first embodiment.

Furthermore, the box-opening device 200 of the second embodiment also has following characteristics.

With the box-opening device 200 according to the second embodiment, the support member 135 of the first holding part movement mechanism 130 includes the arm member 131 and the bearing 133. The first suction cups 21 are attached to the arm member 131. The bearing 133 defines a central turning axis disposed on the imaginary line, and rotatably supports the arm member 131. The central turning axis of the bearing 133 is disposed on the imaginary line IL that extends along the boundary line A between the first side surface T1 and the second side surface T2 of the corrugated cardboard sheet S that is opened by the first holding part movement mechanism 130.

By adopting such a configuration, it is easy to apply a force on the first surface T1 of the corrugated cardboard sheet S solely in the direction in which the force should be applied to open the sheet into a box. In other words, a configuration such as that described above makes it easier to apply only a force that is necessary for turning the first side surface T1 around the first fold portion X12 of the corrugated cardboard sheet S on the first side surface T1. Therefore, it is easy to reliably open the corrugated cardboard sheet S into a box without damaging or deforming the corrugated cardboard sheet S.

With the box-opening device 200 according to the second embodiment, as described above, the bearing 133 of the support member 135 of the first holding part movement mechanism 130 is arranged at a position that is higher than the upper end of the corrugated cardboard sheet S to be opened, and therefore the height of the box-opening unit 10 of the box-opening device 200 tends to increase. Therefore, from the perspective of compactness of the box-opening unit 10, use of the link mechanism 31 as the support member, as with the first embodiment, is preferable.

MODIFIED EXAMPLES

(1) Modified Example A

In the abovementioned embodiments, after the corrugated cardboard sheet S is transformed to an opened state by the first holding part movement mechanism 30, 130, the opened corrugated cardboard sheet S (tubular corrugated cardboard box TB) is moved to the bottom lid forming unit 80 by the movement mechanism 50, but such an arrangement is not provided by way of limitation to the present invention. For example, the box-opening device 200 may be configured so that while the corrugated cardboard sheet S is being opened by the first holding part movement mechanism 30, 130, the movement mechanism 50 simultaneously moves the holding part movement mechanism support part 52 to thereby move the corrugated cardboard sheet S to the bottom lid forming unit 80 side.

REFERENCE SIGNS LIST

21 first suction cup (first holding part)
22 second suction cup (second holding part)
30, 130 first holding part movement mechanism
31 link mechanism (support member)

40 second holding part movement mechanism
131 arm member
133 bearing
135 support member
200 box-opening device
T1 first side surface (first surface)
T2 second side surface (second surface)
IL imaginary line
R, R' central axis of rotation of the first holding part
S corrugated cardboard sheet

The invention claimed is:

1. A box-opening device comprising:

a first holding part that holds a first surface, which is one of two adjacent surfaces of a folded corrugated cardboard sheet;

a second holding part that holds a second surface, which is the other of the two adjacent surfaces of the corrugated cardboard sheet; and a first holding part movement mechanism which changes a position of the first holding part with respect to the second holding part and thereby transforms the folded corrugated cardboard sheet into an opened state, the first holding part movement mechanism having a link mechanism that supports and moves the first holding part by rotating around a drive axis of the first holding part movement mechanism so that the first holding part rotates on an arc track about a central axis of rotation that overlaps an imaginary line extending along a boundary line between the first surface and the second surface, wherein a force only in a circumferential direction about the central axis of rotation is applied to the first surface, and wherein the drive axis of the first holding part movement mechanism is different from the central axis of rotation, the link mechanism is configured to move the first holding part from a first location to a second location closer to the drive axis of the first holding part movement mechanism than the first location, and the first holding part movement mechanism being configured to rotate the first holding part approximately 90 degrees about the central axis of rotation.

2. The box-opening device according to claim 1, wherein the central axis of rotation is immobile during rotation of the first holding part.

3. The box-opening device according to claim 1, wherein a distance between the central axis of rotation and the first holding part is constant during rotation of the first holding part.

4. The box-opening device according to claim 1, wherein the link mechanism is disposed, in an extension direction of the boundary line of the corrugated cardboard sheet that is opened by the first holding part movement mechanism, within a positional range at which the boundary line is present.

5. The box-opening device according to claim 1, further comprising a second holding part movement mechanism that rotates the second holding part about a prescribed rotation axis.

* * * * *